United States Patent [19]

Ehrat

[11] 4,300,298

[45] Nov. 17, 1981

[54] APPARATUS FOR THE PRODUCTION AND DISPLAY OF MOVING PICTURES

[76] Inventor: Kurt Ehrat, Grebweg 17, 8162 Steinmaur, Switzerland

[21] Appl. No.: 933,678

[22] Filed: Aug. 15, 1978

[30] Foreign Application Priority Data

Aug. 19, 1977 [CH] Switzerland ..... 10191

[51] Int. Cl.[3] ..... G09F 19/00

[52] U.S. Cl. ..... 40/430; 40/423; 40/464; 40/466; 178/17.5; 340/800; 340/806; 340/808

[58] Field of Search ..... 40/429, 430, 436–437, 40/438, 446, 447, 449, 452, 463, 464, 466, 508, 509, 421, 423, 427, 435; 340/806–808, 792, 800, 801; 178/17.5

[56] References Cited

U.S. PATENT DOCUMENTS 2,006,999 7/1935 Nachumsohn ..... 178/17.5
3,281,824 10/1966 Naxon ..... 340/334
3,751,825 8/1973 Barrett ..... 340/780 X

*Primary Examiner*—Gene Mancene
*Assistant Examiner*—G. Lee Skillington
*Attorney, Agent, or Firm*—McAulay, Fields, Fisher, Goldstein & Nissen

[57] ABSTRACT

Apparatus for generating and displaying moving pictures in which a combination of a number of locally displaceable picture elements have positions that are variable and/or selectable by a number of adjustable outer or final control elements. At least part of individual final control elements have associated with them an inner control element. The position of the final control elements is variable in response to the action of the control elements, and these inner control elements are arranged on a movable inner control element carrier. The control elements constitute mechanical information storages in which the information has a total of at least two mechanical states and can be transmitted by mechanical contact to the associated final control elements, and hence to the picture elements. The information of the inner control elements is made variable by moving the control element carrier.

38 Claims, 34 Drawing Figures

AX2
5
I
41
P2a÷h
P1a÷h
P'1a÷h
φB
60
69
45b
P1z
P2z
12
1b
52
51
45a
43h
Bs
7Bs
10
11b
43c
43b
43a
AX3
39
φB
11a
10b
13
9
53
50
11
10
61
49
45
AX1
P3z
54
41
Sd
S3(1)
Sa
48
I
Sd
S2(0)
Sa
Sb
S1(1)
Sa
P3 a÷h

APPARATUS FOR THE PRODUCTION AND DISPLAY OF MOVING PICTURES

BACKGROUND OF THE INVENTION

The two best known devices for the production and display of moving pictures are the film projector and the television receiver. Both devices have been perfected to a high degree, but each requires relatively complex and expensive apparatus.

The apparatus in accordance with the present invention has the purpose of displaying a very large number of different moving pictures with simple and inexpensive means, mostly of a mechanical nature. It is distinguished by the fact that the positions of picture elements are variable and/or selectable by means of a number of adjustable final control elements; and that the individual final control elements are at least partially assigned one control element each temporarily, with the position of the final control elements being adjustable by the action of the control elements and the control elements arranged on a movable control element carrier and constituting mechanical information storages whose information consists of a total of at least two mechanical conditions and is transmitted by mechanical contact to the corresponding final control elements and thus via connecting means to the picture elements, with the information of the control elements being changeable by moving the control element carrier.

BRIEF DESCRIPTION OF THE DRAWINGS

The invention is now described in conjunction with the figures which illustrate the presently preferred mode of practicing the invention, in which:

FIG. 4 shows a top view of the right-hand half of the apparatus and the left-hand half in a sectional view taken on line B—B of FIG. 5; and, FIG. 5 shows a view as viewed in the direction of arrow F of FIG. 4 with development onto the tangent T, and FIG. 6 is a sectional view taken on line A—A of FIG. 4.

FIG. 29 is an enlarged perspective view, partially in section.

FIG. 30 is a sectional view taken along line H—H of FIG. 29.

FIG. 31 is a reduced overall view of variable pictures formed from the picture elements.

DESCRIPTION OF THE PREFERRED EMBODIMENTS

Figure 1:
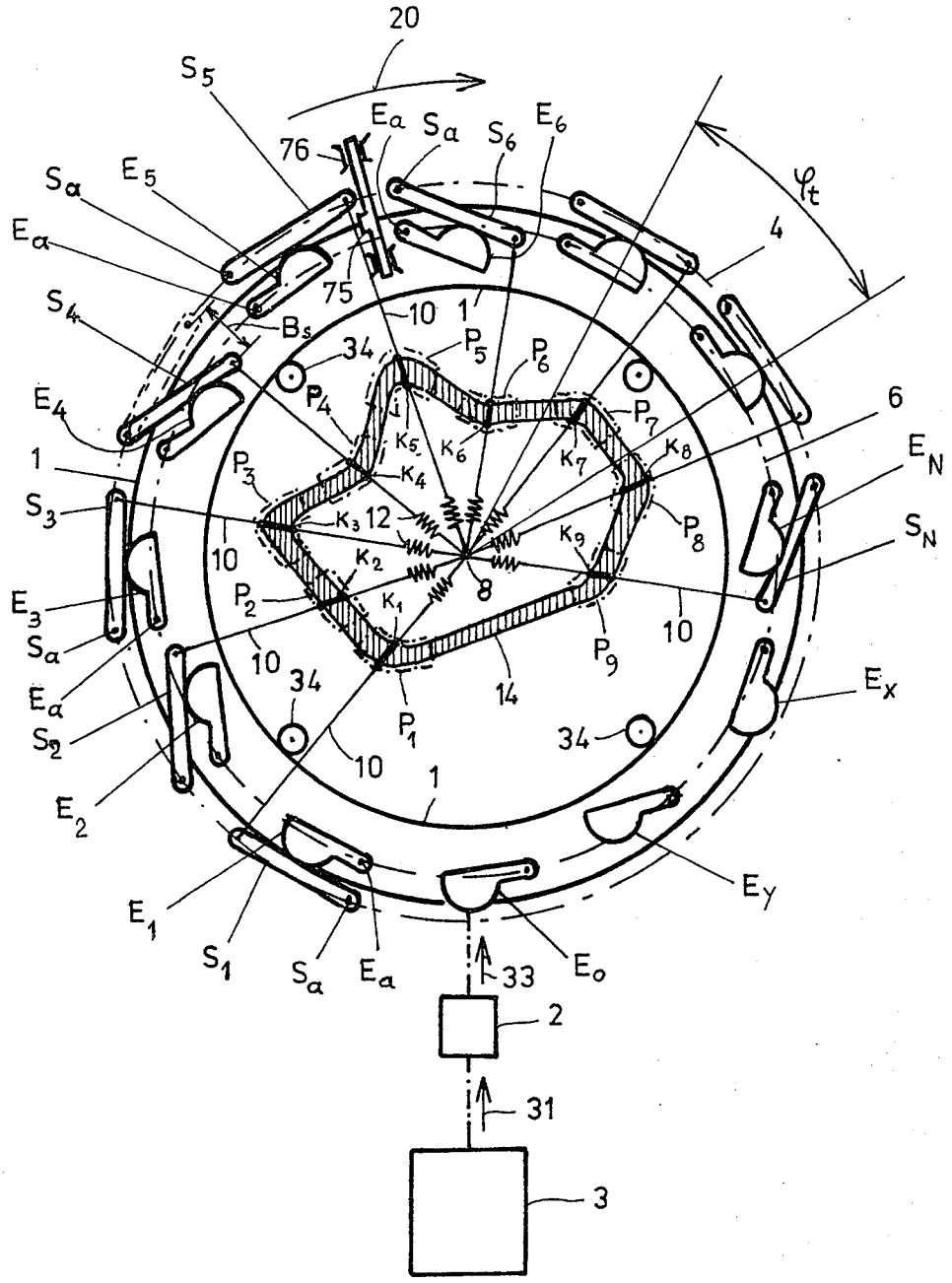
FIG. 1 shows a simplified arrangement of a first embodiment of the apparatus according to the invention.

Referring now more particularly to the drawings which illustrate the preferred embodiments and the best mode presently contemplated for carrying out the invention, reference is made to FIG. 1 to explain the invention. Control elements $E_1$ to $E_N$ are arranged on a control element carrier 1. Each of the control elements are individually pivotable about axes $E_a$ at an end thereof and each have the form of levers. Control element carrier 1 is rotatable in the direction of arrow 20. The control element carrier is constructed as a rotatable rotor 1 in the form of a circular ring body which is guided on rollers 34. The control elements can assume two different binary positions denoted by "zero" and "one"; the position directed outwardly with respect to the rotor center, applying in FIG. 1 to control elements $E_o$ or $E_l$, is denoted by "one" and the inwardly directed position, applying in FIG. 1 to control elements $E_2$ or $E_4$, is denoted by "zero." The control elements are fixed in their binary positions by stop springs (not shown) or by friction.

FIG. 1 shows as an example twelve control elements. However, there may be any number, such as an arbitrary number of control elements, denoted generally by $E_N$. The control elements $E_N$ are circularly distributed and arranged on a control element circle 6 at a constant angular spacing distance $\phi_t$ between two adjacent control elements.

The final control elements $S_1$ to $S_N$ are located on a final or outer control element circle 4 which is concentric with the control element circle 6. The final control element $S_1$ to $S_N$, are constructed as levers and are arranged with the same angular difference $\phi_t$ between each pair of adjacent final control elements as that of the control elements. Each of the final control elements are pivotable about their own fixed axes $S_a$ and are adjustable by mechanical contact by means of the control elements $E_N$. The final control elements are generally denoted by the reference character $S_1, S_2 \ldots S_N$. In the angle position drawn in FIG. 1, each final or outer control element $S_N$ is associated with one inner control element $E_N$. For example, final control element $S_1$ is associated with inner control element $E_1$, final control element $S_2$ with control element $E_2$ and final control element $S_N$ with control element $E_N$. As shown in FIG. 1, the final control elements receive the mechanical information, i.e., the binary position of the associated inner control elements. The association of all final or outer control elements with their inner control elements changes after rotation of rotor 1 by one angular or arcuate distance $\phi_t$ such that after each rotor rotation through the angle $\phi_t$, all final or outer control elements will have a new binary position displaced from its previous binary position.

Of the twelve inner control elements shown in FIG. 1, only nine have final or outer control elements associated with them. The control elements Ex, Ey and Eo are not encumbered by or associated with final or outer control elements and are freely adjustable. The final control element circle 4 has a gap of or is missing three final control elements. The final control elements which is located closest to the gap in the direction of rotation 20 is denoted by $S_N$, and its associated inner control element is denoted by $E_N$. Thus, $E_N$ denotes both the inner control element assigned to the last final control element $S_N$ and generally the last control element in the series of final control elements. For example, the variable picture of FIG. 1 consists of an elastic string or an elastic thread 14 connected at various fixing points $K_1$ to $K_9$ to a connection means 10 consistng of pull strings or wires which connect the final or outer control elements $S_N$ with picture elements $P_n$. These connection means 10 may also be ropes, chains or rigid connecting rods.

The figures always have a number of final control elements $S_N$, a number of control elements $E_N$, a number of picture elements $P_n$. The symbols for these three elements always contain the capital letter S for the final or outer control elements, the capital letter E for the inner control elements and the capital letter P for the picture elements. The individual subscripts or indices N or n stand for the general description of these elements while other indices are used in the figures in order to distinguish one element of the same type from others.

Accordingly, FIG. 1 contains nine of the picture elements which are designated $P_1$ to $P_9$ corresponding to the total number of final control elements. Each of the picture elements is controlled by its own associated final control element. These picture elements are separated by the elastic thread 14 in the neighborhood of the fixing points $K_1$ to $K_9$ of pull strings 10 to the elastic thread 14. Springs 12 at the ends of the pull strings pull or press the final control elements against their associated inner control elements so that the binary positions of the final control elements, scanned by the control elements, are transferred to the picture elements. The detenting of the control elements must be so effective that they retain their binary positions even under the action of spring 12.

The picture in FIG. 1, formed from the picture elements $P_1$ to $P_9$ somewhat resembles a plant leaf and only serves for the purpose of explanation.

During each rotation of the rotor 1 by one angular distance $\phi_t$, the association between the inner control elements and final control elements is changed and the entire picture consisting of picture elements is also changed.

Instead of having only two discrete binary positions, the control elements $E_N$ may also be adjustable to an arbitrary number of intermediate positions.

The picture elements $P_n$ may also be mounted on an elastic foil. Furthermore, the picture elements may consist of individual components independent of each other whose total again results in the variable picture.

The control elements may be adjustable either manually or mechanically by machine. The stationary adjustment device 2 located at a point in the vicinity of the control element circle is used for machine adjustment. In FIG. 1, this adjustment device is schematically shown in the form of a block, and it is described in greater detail in connection with FIGS. 4 to 11. During rotor rotation, the adjustment device permits the information of the control elements to change as they sequentially pass one control element after the other, for example in FIG. 1 control elements Eo, Ey, then Ex. If the information of the control elements consists of binary conditions "zero" or "one", the adjustment device 2 permits adjustment of the control element to either binary state. The information transfer from the adjustment device 2 to the control element is marked by arrow 33.

Program transmitter 3, shown in the block schematic of FIG. 1, controls the adjustment device 2. For the case where control elements may assume two binary states "zero" and "one", the program transmitter produces an information "zero" or "one" for each rotation of rotor 1 through angular distance $\phi_t$ and transfers this information 31 indirectly via the adjustment device 2 to the control elements. Examples of program transmitters are described below.

The information bits 31 and 33 may consist of mechanical binary states, "zero" and "one", similar to those of the control elements.

The program transmitter supplies all program sequences of program elements "zero" and "one" which may, for example, have long periods or may be pure random sequences. During each rotation of the rotor 1 through an angular distance $\phi_t$, a program element is transferred to a control element running past the adjustment device 2. The picture consisting of the picture elements is continually changed in accordance with the program of the program transmitter 3, and always with the same totality of the same control elements. Of course, not only one, but several adjustment devices and several program transmitters may be present on the periphery of the control element circle.

The stroke or movement of the final or outer control elements from one of its extreme positions to the other is called unit path $B_s$. See the path indicated by the double-headed arrow in FIG. 1 for final control element $S_4$. This stroke path, for a better defined picture formation, could be individually limited for individual final control elements by means of adjustable fixable stops 75. Such a stop which is radially movable in guides 76 and is fixable by means not shown here and is shown schematically drawn in FIG. 1 for final control element $S_5$.

An extremely economical and expedient type of program transmitter is obtained by connecting the inner control elements $E_N$ plus control element carrier or rotor 1, together with at least individual final control elements $S_N$ and an adapted adjustment device 2 as a feedback shift register.

The modes of operation of feedback shift registers are sufficiently known from electronics technology and are described in:

(a) Shift Register Sequences By S. Golomb (Holden-Day Inc., San Francisco 1969)
(b) Shift Register Generation of Pseudorandom Binary Sequences By R. Krishnayew and J. Donovan (Computer Design, April 1973)
(c) Error Correcting Codes By W. W. Peterson (John Wiley & Son 1961)
(d) "Electronics" Nov. 27, 1975, page 104
(e) "Electronics" May 27, 1976, page 107

Figure 2:
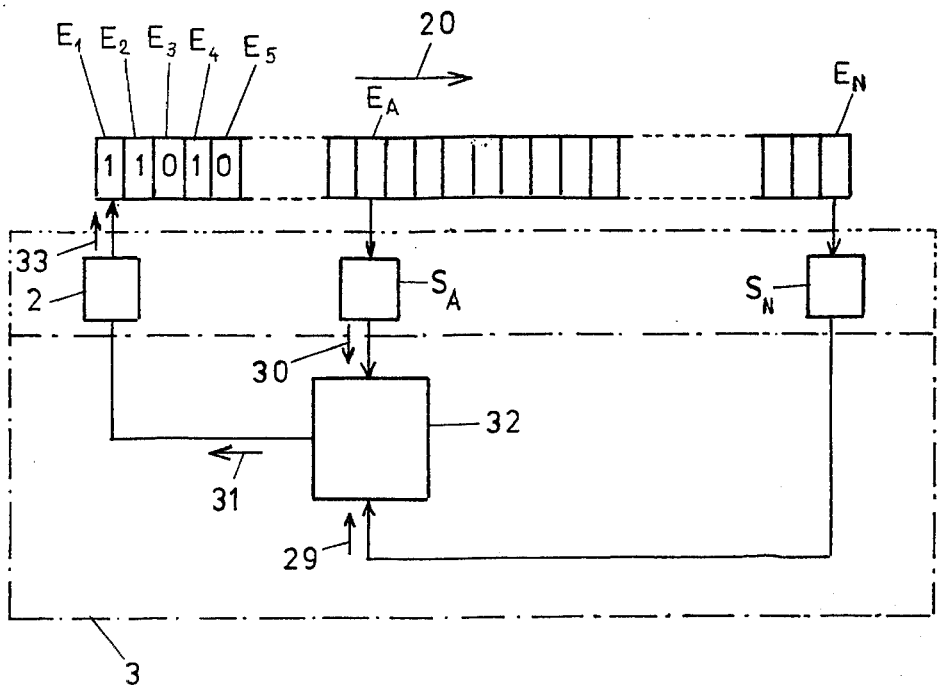
FIG. 2 shows a general block schematic of a feedback shift register as component of the embodiment according to FIG. 3.

FIG. 2 shows the general block schematic of an example of a feedback shift register. It consists of the N register stages $E_1$ to $E_N$ whose information may consist of binary states "zero" and "one". This information can be shifted in steps, by one register step per shift step, in the direction of arrow 20. Accoring to FIG. 2, one shift step shifts information "1" from register stage $E_4$ to register stage $E_5$, information "0" from register stage $E_3$ to register stage $E_4$, information "1" from register stage $E_2$ to register stage $E_3$, and information "1" of register stage $E_1$ to register stage $E_2$. The register stage $E_1$ forms the shift register input which receives its input information 33 via the input stage 2. The input information 33 is identical with information 31 generated by the Modulo-2 mixer 32, see FIG. 3, but made suitable for feeding in the shift register input by the input stage 2.

The Modulo-2 mixer 32 receives its input information 29 and 30 indirectly via the output stages $S_A$ and $S_N$ from a register stage $E_A$, denoted as tapping stage, and at the last register stage $E_N$ of the shift register output.

The Modulo-2 mixer 32 is a circuit element which is widely used in binary digital practice and is also called an Exclusive-Or gate. The connections between input and output information in the Modulo-2 mixer are in accordance with the following Table I which shows the binary states of 29, 30, and 31 or 33:

TABLE I

| Binary States Of: | | |
|---|---|---|
| Input Information 29 | Input Information 30 | Input Information 31 or 33 |
| 0 | 0 | 0 |
| 1 | 1 | 0 |
| 0 | 1 | 1 |
| 1 | 0 | 1 |

The output stages $S_A$ and $S_N$ deliver the information taken from register stages $E_A$ and $E_N$ to the Modulo-2 mixer wthout changing the binary states. The output stages have no logic function.

The elements shown in FIG. 2 enclosed by a dash-dot line form the program transmitter 3 which controls the input information 31 or 33 of the shift register input.

The sequence of input information bits 31 or 33 which develops during the stepwise switching of the shift register, shift step by shift step, constitutes the shift register program generated by the program transmitter 3.

The input stage 2 and the output stages $S_A$ and $S_N$ may be integrated in the program transmitter 3 which is illustrated by the dash-double-dot line in FIG. 2.

The number N of register stages $E_N$ and the position of tapping stage $E_A$ in the shift register are advantageously selected such that the generated shift register program which is the sequence of information bits 31 or 33, has a maximum period, i.e., that any combination of binary information bits of all register stages is repeated only after $2^N-1$ shift steps.

Four examples of such shift registers with a maximum period program can be obtained from the above-mentioned literature citation (e) Electronics 1976 and are listed in the following Table II:

TABLE II

| Number of Register Stages N | Position of Tapping Stage $E_A$ in Number of Register Stages From Shift Register Input $E_1$ | Period Length of Shift Register Program $2^N - 1$ in Number of Shift Steps |
|---|---|---|
| 10 | 3 | $2^{10} - 1 = 1023$ |
| 17 | 3 | $2^{17} - 1 = 131{,}071$ |
| 31 | 3 | $2^{31} - 1 - 2{,}147{,}483{,}647$ |
| 41 | 3 | $2^{41} - 1$ - about $2.2 \times 10^{12}$ |

A feedback shift register with 17 register stages repeats only after a period of 131,071 shift steps. While running through the entire period, each of the $2^{17}$ possible combinations of binary positions of all register stages occurs once, but only once, with the following exception:

The combination where all binary positions are "zero" does not occur.

The invention is not restricted to this described type of feedback shift registers with only one tapping stage and only one Modulo-2 mixer, but also includes feedback shift register circuits with several tapping stages and several Modulo-2 mixers.

The programs, i.e., the sequence of information bits "0" and "1" of such feedback shift registers have so-called pseudorandom character.

In digital electronics, the binary states "zero" and "one" are marked or designated by different electric potentials, while with mechanical devices they are represented by two different positions of levers or elements, the two binary positions "zero" and "one".

The mechanical arrangement described in connection with FIG. 1 can be operated like the feedback shift register described in connection with FIG. 2 when the program transmitter 3 contains a Modulo-2 mixer 32 whose input information bits 29 and 30 are obtained from the binary position of the final control elements $S_N$ and $S_A$ which binary positions in turn are scanned by those of the associated control elements $E_N$ and $E_A$. The output information 31 of Modulo-2 mixer 32 is applied via the adjustment device 2 as input information 33 for adjusting control elements running past during the rotation of rotor 1.

Figure 3:
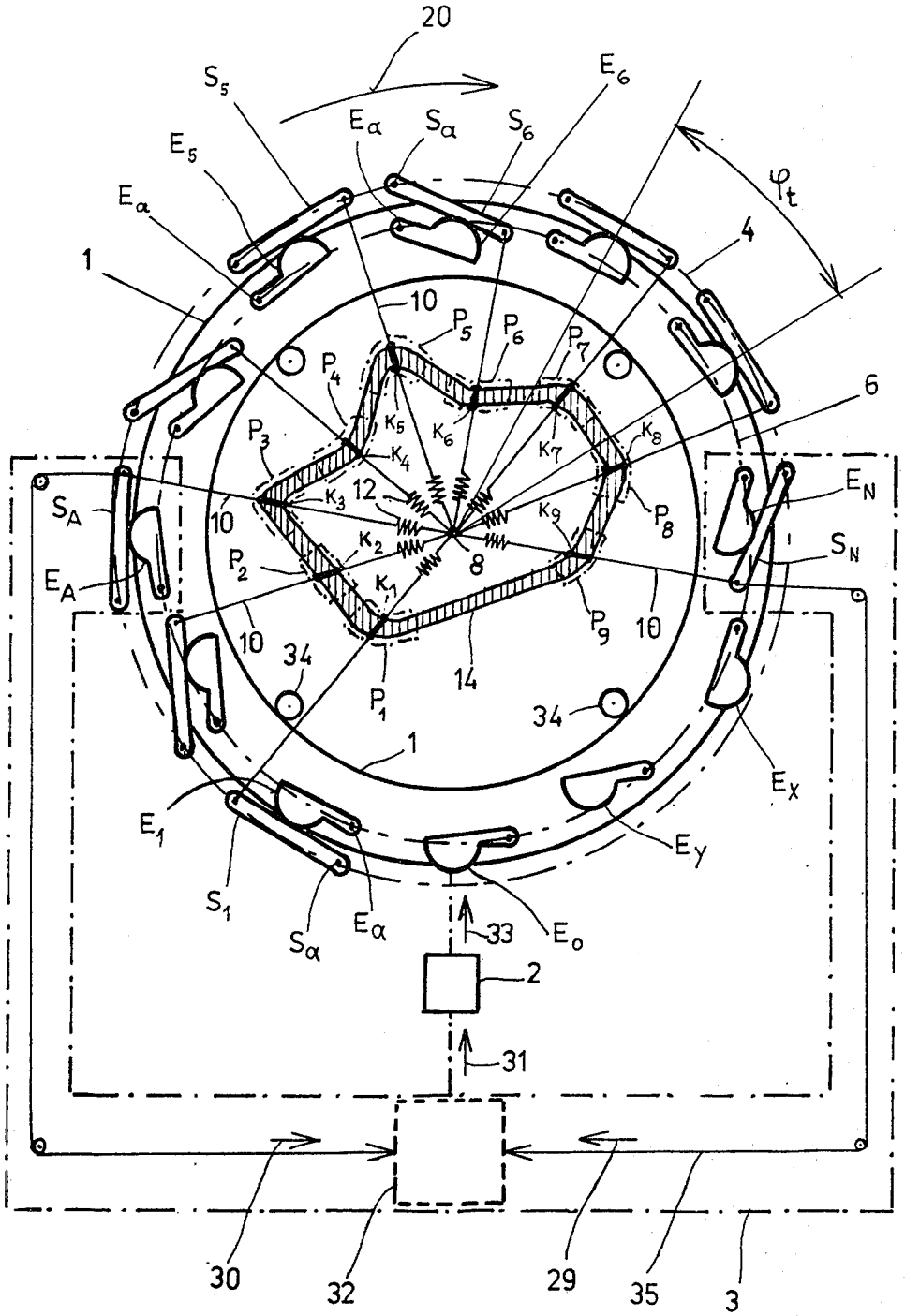
FIG. 3 shows a simplified arrangement of a second embodiment of the apparatus.

Such a device, operating as a mechanical feedback shift register for the generation and display of moving pictures is shown in a simplified form in FIG. 3. The effect of the change of picture elements is similar to that of FIG. 1; however, the program transmitter 3 contains the Modulo-2 mixer 32 which is controlled by final control elements $S_A$ and $S_N$. Final control element $S_3$ and associated inner control element $E_3$ in FIG. 1 are denoted here as final or outer control element $S_A$ and inner control element $E_A$.

In order to compare the mechanical shift register of FIG. 3 with the block schematic of FIG. 2, the following applies:

1. The register stages $E_l$ to $E_N$ of FIG. 2 correspond to the control elements $E_l$ to $E_N$ in FIG. 3.
2. The input information 33 of the shift register is entered in FIG. 2 directly on the register stage $E_l$ of the shift register input, but in FIG. 3 it is entered on control element Eo; in the latter case, after performing a shift step, the input information is contained in control element $E_l$.
3. The shift register input in FIG. 3 is fixed on inner control element ($E_l$) which is associated with final or outer control element $S_l$, and the shift register output of FIG. 3 is fixed on control element ($E_N$) which is associated with the final control element $S_N$. The tapping stage $E_A$ is associated with the final control element $S_A$.
4. The control elements denoted in FIG. 3 by Ex, Ey and Eo are located outside the feedback shift register.
5. The input stage 2 of FIG. 2 corresponds to the adjustment device of FIG. 3, the output stages and $S_A$ and $S_N$ correspond to the final control elements $S_A$ and $S_N$ of FIG. 3.
6. In FIG. 3, the binary position "zero" corresponds to the position of control element or final control element tilted towards the center of rotor 1 and the binary position "one" corresponds to the outwardly tilted position.
7. A shift step in FIG. 3 corresponds to the displacement of rotor 1 through an angular distance $\phi_t$ in the direction of arrow 20.
8. In FIG. 2, only the information of tapping stage $E_A$ and of register stage $E_N$ of the shift register output can be scanned; while in FIG. 3, the binary positions of nearly all the inner control elements $E_l$ to $E_N$ can be scanned simultaneously. With these binary positions scanned by the final control elements $S_l$ to $S_N$, the position of the picture elements $P_n$ is changed by means of the connecting means 10, and hence the picture is also changed.
9. The control elements Ex, Ey, Eo located in FIG. 3 between shift register output ($S_N$) and shift register input ($S_l$) are not encumbered or blocked by any final control elements and therefore can be easily changed.

The mechanical feedback shift register shown in FIG. 3 has nine register stages. (The register stages Ex, Ey, Eo are outside the shift register.)

If the number of register stages where chosen in which N=17, according to the above Table II, with the stepwise rotation of the rotor 1 by 131,071 shift steps, then 131,071 pictures can be produced, each of these 131,071 pictures occurring only once.

Another embodiment of the apparatus in accordance with the present invention will be described by means of FIGS. 4 to 10.

Figure 4:
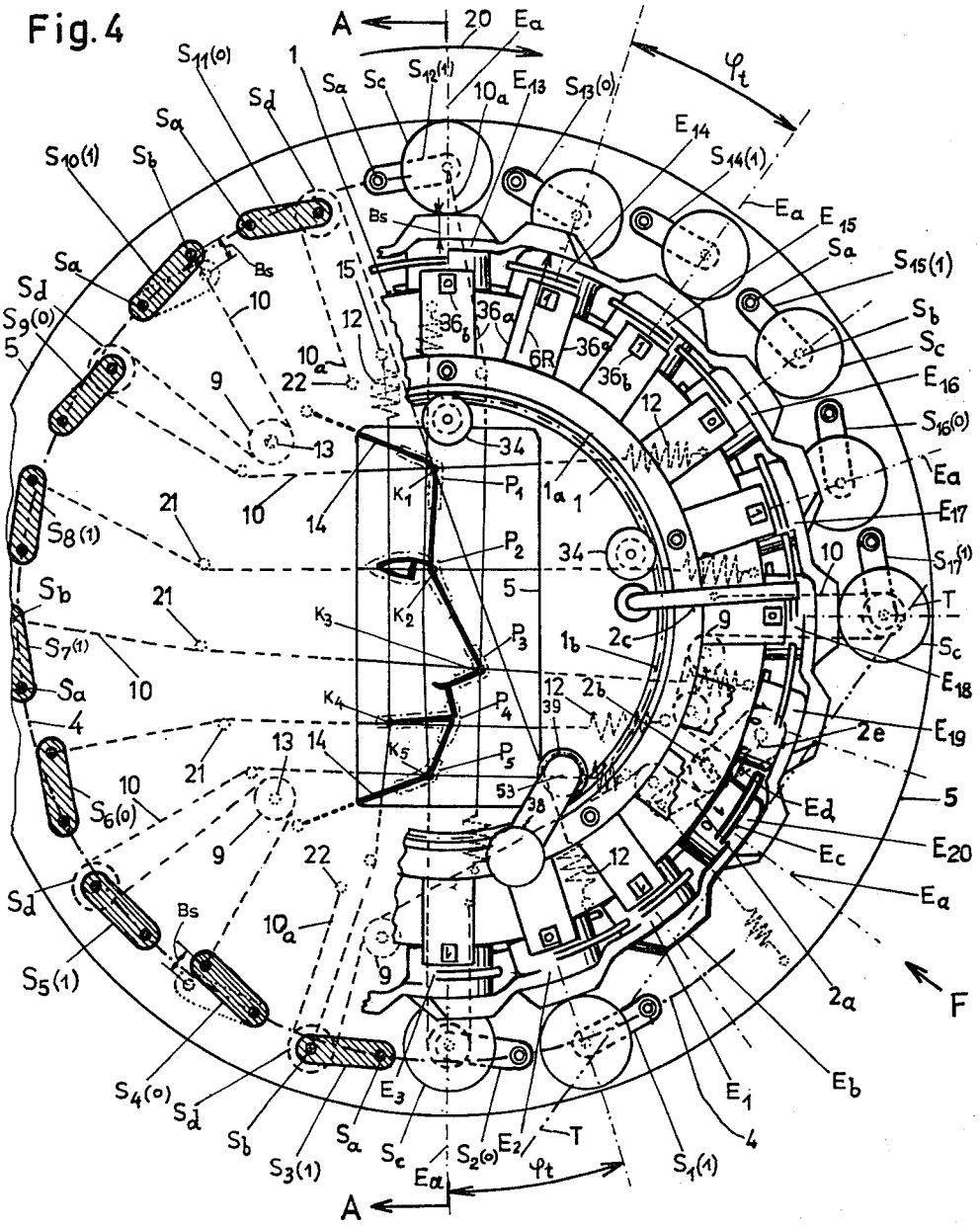
FIGS. 4 to 6 shows another embodiment of the apparatus.
Figure 5:
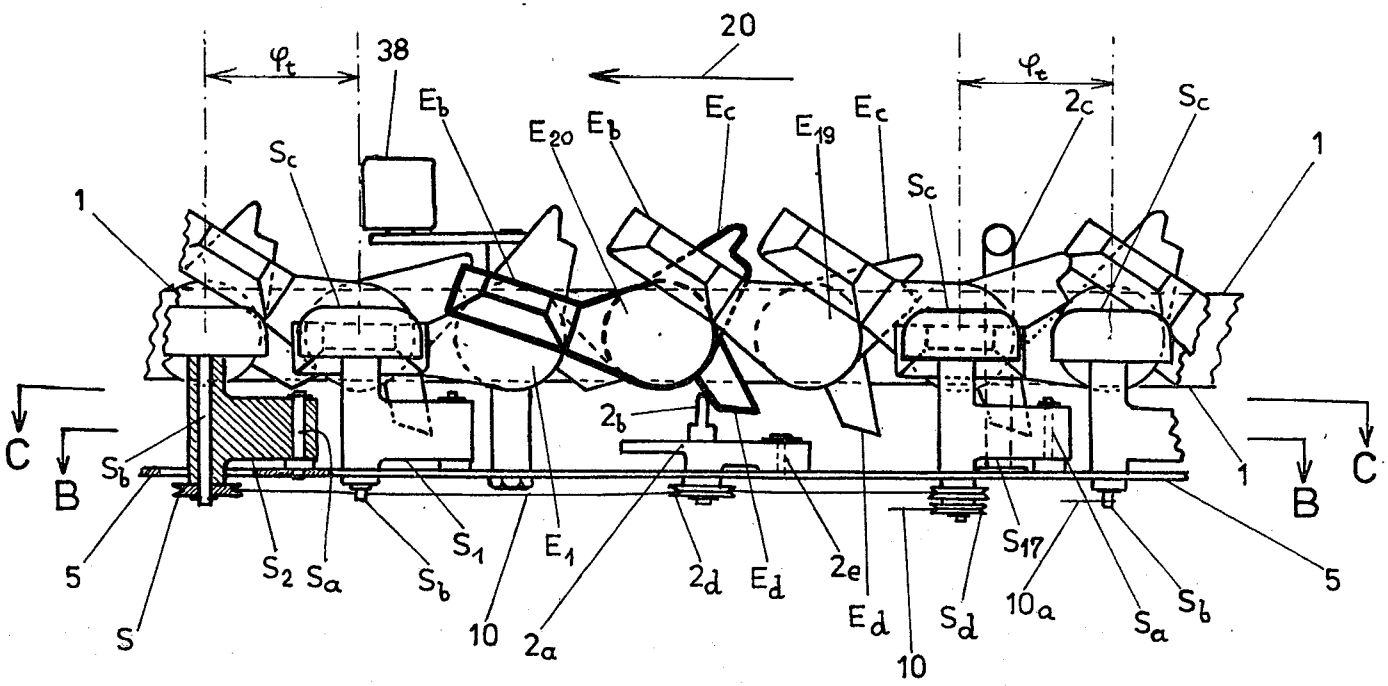
Figure 6:
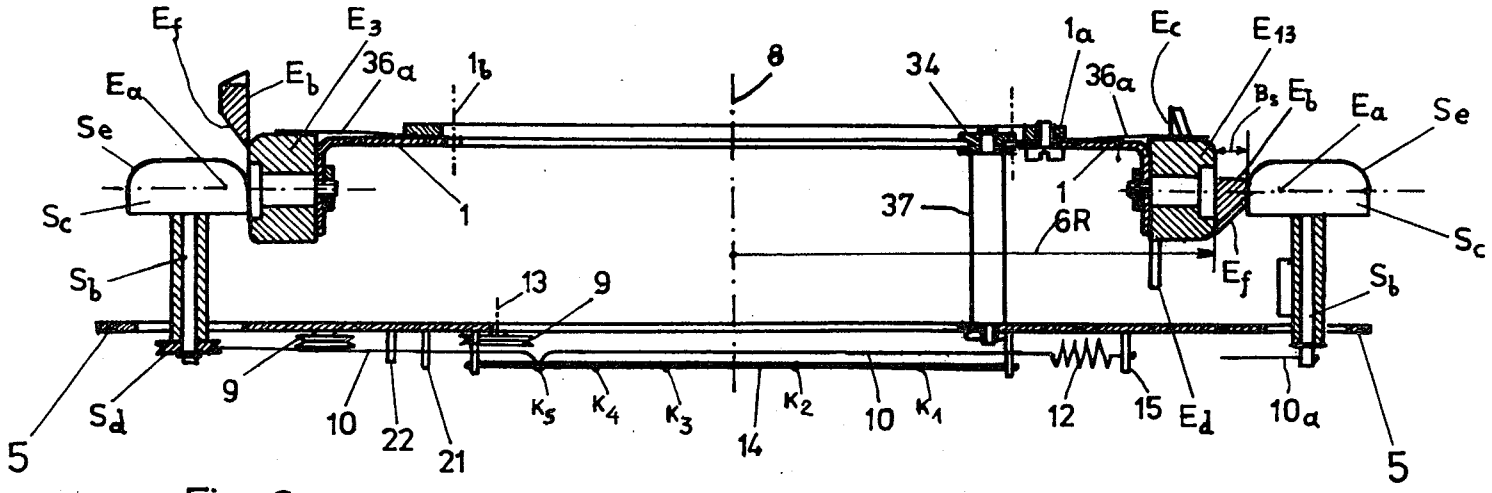

The mode of operation of the embodiment according to FIGS. 4 to 10 is similar to the embodiment described in connection with FIG. 3, but it is described in more detail by means of FIGS. 4 to 6 and contains design improvements. This embodiment contains a rotor 1 mounted on rollers 34. Rotor 1 is shaped in the form of a circular ring and acts as control element carrier. The rollers 34 are rotatably mounted on studs 37, and these are fastened in a fixed stator 5. Both the stator and rotor, whose cross sections are shown in FIG. 6, are made of sheet metal. However, with proper modification they may be made of plastic.

As noted, in FIG. 3, the inner control elements $E_N$ on rotor 1 are one-arm levers whose axes of rotation $E_A$ are located on the inner control element circle 6 and run parallel to the rotor axis 8. By contrast in the embodiment of FIGS. 4 to 6, the control elements consist of multi-arm levers whose axes of rotation $E_a$ are located in a circular plane of the rotor and are directed radially towards the rotor axis 8. The inner control elements $E_N$ are arranged on the rotor periphery along the inner control element circle with radius 6R.

Twenty inner control elements $E_N$ ($E_l$ to $E_{20}$) are arranged on the rotor periphery with the angular distance $\phi_t$ between adjacent control elements. Of these control elements, seventeen control elements $E_N$ ($E_l$ to $E_{17}$) can be scanned simultaneously by seventeen associated final or outer control elements $S_N$ ($S_l$ to $S_{17}$). Similar to FIG. 3, the arrangement constitutes a mechanical feedback shift register with N=17 register steps. The shift register input is fixed at final control element $S_l$, and the shift register output is fixed at final control element $S_{17}$. Control element $E_3$ associated at any particular time with final control element $S_3$ corresponds to tapping stage $E_A$. The output stages $S_A$ and $S_N$ of FIG. 3. correspond to the final control elements $S_3$ and $S_{17}$ of FIG. 4 which yield the input information bits 29 and 30 of the Modulo-2 mixer described below. A shift step of the shift register corresponds to a rotation of rotor 1 through the angular distance $\phi_t$ in the direction of arrow 20. The program period of the feedback register with N=17 is, as stated above, $2^{17}-1=$ 131,071; this means that any combination of the binary positions of all the final control elements repeats itself only after 131,071 shift steps.

The control elements of the embodiment of FIGS. 4 to 6 consist of three-armed levers which can be tilted about their lever axes Ea into the binary positions "zero" and "one".

One lever arm, referred to as action lever $E_b$, is used for transmitting the binary positions of the inner control elements to the associated final control elements. If the action lever $E_b$ is in the horizontal position (FIG. 5), it corresponds to the binary position "one" of the control elements. In this position, the associated final control element $S_N$ is pressed via a roller $S_c$ by the thickness $B_s$ (see FIG. 6) of the action lever $E_b$ radially outward into the binary position "one" of the final control elements. If the action lever $E_b$ is in its up-tilt position (FIG. 5), the binary position "zero" of the control elements is present. In this position, the roller $S_c$ of the associated final control element $S_N$ can drop radially inwardly to the periphery of the inner control element circle with radius 6R, thereby placing the final control element in the binary position "zero". The path transversed by the final control element from its binary position "0" to its binary position "1" corresponds to the thickness of the action lever $E_b$ and is called unit path $B_s$.

In FIGS. 4 and 5, for example, inner control element $E_l$ and associated final control element $S_l$ are in binary position "one" and inner control element $E_2$ and associated final control element $S_2$ are in binary position "zero". It should be noted that the lever arm length of the action levers corresponds to the angular distance $\phi_t$ (FIG. 4) whereby the axis of rotation $E_a$ of a control element $E_N$ is displaced by the angular distance $\phi_t$ from the roller axis $S_b$ of the roller $S_c$ of the associated final control element $S_N$. The second inner control element lever arm, referred to as zero lever $E_c$ permits the machine change of the control elements to the binary position "zero" during the rotation of rotor 1 in that the (control elements run past a zero-positioning stop 2c which belongs to the adjustment device 2 and is fastened to stator 5; this stop $2_c$ pushes the zero levers $E_c$ downward (FIG. 5) and hence pushes the action levers $E_b$ upward. The zero lever $E_c$ is also suitable for the manual displacement of the control elements to the two binary positions. By means of the third lever arm, referred to as one-lever $E_d$, the machine displacement of the control elements to the binary position "one" during rotation of rotor 1 is made possible because the inner control elements run past an adjustable lever 2a which is located in stator 5 and belongs to the adjustment device 2; at one position of the adjustment lever, the one-lever $E_d$ is pushed upward (FIG. 5) and hence the action lever $E_b$ is pushed downward to the binary position "one".

By being stopped by the adjacent control element, zero lever $E_c$ one-lever $E_d$ effect a movement restriction of the control elements.

The leaf springs 36a (FIGS. 4 and 6) are fastened by means of ring 1a on the rotor 1 and press against the inner control elements and hold them by friction in their position. Of course, these leaf springs may also be stop springs.

The leaf springs 36b have windows through which one of the digits "0" or "1" placed on the control elements is visible to indicate the binary position of the control element. In a plane of intersection containing the rotor axis, the action levers $E_b$ have a wedge-shaped cross section with a wedge area $E_f$ (FIG. 6) which makes it possible for the control elements to be reset manually from the binary position "zero" to "one" at any position of the rotor, even with pressed-on roller $S_c$ of final control elements $S_N$. To facilitate this reset, the rollers $S_c$ have a rounded section as shown in the side view (FIG. 6).

The final control elements $S_N$ ($S_1$ to $S_{17}$) consist of switch levers which are tiltably mounted on axes of rotation $S_a$. These axes of rotation $S_a$ are fixed in the stator 5 and run parallel to axis 8 of rotor 1. These axes of rotation are arranged along a circle, referred to as final control element circle 4, outside the rotor periphery.

The final control elements $S_N$ taking the form of switch levers have at their movable ends the roller axes $S_b$ running parallel to the rotor axis which at the upper end (FIG. 6) carry the roller $S_c$ scanning the action lever $E_b$ and at the lower end has a guide device for a rope or a string or wire 10, or one or more loosely mounted rope pulleys $S_d$. The ropes or the strings 10 are the connecting means between final control elements $S_N$ and picture elements $P_n$, and these ropes or strings are kept taut by springs 12 in such a way that the rollers $S_e$ of the control links are pressed against the associated control elements or their action levers $E_b$, to scan the binary positions of the inner control elements by the final control elements. In contrast with the arrangement of FIG. 1 or 3, in the embodiment of FIGS. 4 to 6, the final control elements do not exert a torque around axis Ea on the control elements, stably maintaining the binary positions of the control elements.

In a manner similar to the embodiments of FIG. 1 or 3, the picture elements $P_n$ ($P_1$ to $P_5$) consist of parts of an elastic string which is connected at points $K_1$ to $K_5$ to the connecting means 10. In this embodiment, and as best seen in FIG. 4, the variable picture formed from the picture elements represent the profile of a human face. The picture elements represent the various facial portions. For example, picture element $P_1$ represents the forehead, $P_2$ represents the eye portion, and $P_3$ represents the nose portion, etc.

The picture elements are adjustable in two coordinate directions, horizontally and vertically. For example, picture element $P_1$ is adjustable horizontally by means of final control elements $S_9$ and $S_{10}$, and nearly vertically by means of final control element $S_{11}$. Picture element $P_2$ is adjustable horizontally by means of final element $S_8$ and is adjustable vertically by means of final control element $S_2$. Picture element $P_3$ is adjustable approximately horizontally by means of final control element $S_7$ and is adjustable vertically by means of final control element $S_{12}$.

FIG. 4 shows only the connecting means 10 of the left-hand half of the final control element to the picture elements. Of course, in an analogous manner, the final control elements of the right-hand half may be connected to picture elements. The prevailing binary position ("0" or "1") of the individual final control elements is noted by a number in parentheses (0) or (1) behind the final control element designation. During each rotation of rotor 1 through the angular distance $\phi_t$, the picture of the human face is changed. The rotor rotation may be produced, for example, by a handcrank 38 whose rotary motion is transmitted via gear 39 with axis 53 to the internal teeth 1b of the rotor. Of course, the rotor may also be motor-driven.

The connecting means between final control elements and picture elements will be referred to below as pull strings 10. The pull strings may be fastened directly to the movable end of the final control elements which are constructed as switch levers, and hence to the roller axis $S_b$, as shown on the right-hand side of FIG. 6 where the string end $10_a$ is connected to roller axis $S_b$.

In FIG. 4 on the switch levers $S_6$, $S_7$ and $S_8$ representing the final control elements, the pull strings 10 are fastened directly to the roller axis $S_b$, whereby the lever movement when changing from one binary state to the other is transmitted with a single movement amplitude of the unit path $B_s$ to the pull string and hence to the picture element.

Deflection bolts 21 are fastened to stator 5 to allow correction of the direction of motion of picture elements $P_n$.

On switch lever $S_{11}$, the string end $10_a$ is fixed by means of a fastening bolt 22 to the stator 5; the string 10 is run with an 180° contact over rope pulley $S_d$ whereby the switch lever movement during transition from one binary state to the other is transmitted with the double movement amplitude $2B_s$ to the string and hence to the picture element. The string may also be wrapped once or several times via deflection rollers 9 with roller axis 13 fastened to the stator and rope pulleys $S_a$ of the same switch lever, with the switch lever movement being multiplied and transmitted to the string end and hence to the picture element.

Furthermore, the string end $10_a$ may be fixed to a first switch lever ($S_N$), and the string 10 may be run alternately over deflection rollers 9 with fixed roller axis 13 and rope pulleys $S_a$ of $(n-1)$ additional switch levers, and the motion of the first switch lever $S_N$ is transmitted with a 2° fold, hence with the single motion amplitude 1 $B_s$; the motion of the second switch lever $S_{(N+1)}$ is transmitted with a $2^1$ fold, hence with the double amplitude $B_s$; the motion of the third switch lever $S_{(N+Z)}$ is transmitted with $2^2$ fold, hence four times the motion amplitude 4 $B_s$ to the string 10; and hence generally the motion of the n-th switch lever $S_{(N+n)}$ is transmitted with $2^{n-1}$ times the motion amplitude, $2^{n-1}$. $B_s$ to the string 10. All of these motions are automatically added in this rope pulley transmission, and therefore, the second string end 10*b* which is fastened to one picture element during joint action of n switch levers with their $2^n$ possible combinations of binary positions may assume $2^n$ different positions. The unit motions from one binary position to the other with the unit path $B_s$ of n switch levers are transformed into a total motion with the maximum path of $(2^n-1)$, with $2^n$ different possible positions which are separated by the unit path $B_s$ from each other. The process herein described is well known in electronics under the name of digital-analog conversion.

As an example, the horizontal motion of picture element $P_1$ of FIG. 4 will be explained. The position of this picture element is determined by the binary positions of the two final control elements $S_9$ and $S_{10}$. With n=2, the picture element may have $2^2=4$ different positions which are apart by the unit path $B_s$ and with the possible maximum path of the picture element $P_1$ being $(2^2-1)$ $B_s=3$ $B_s$.

Another example of this analog-digital conversion will be explained in connection with FIG. 27.

The string end $10_b$ may be fastened to a selection device 11 for the selection of picture elements, instead of directly to a picture element. Such a selection device which is controlled by n=3 switch levers with the possibility of $2^3=8$ different position and is explained hereinafter by reference to FIG. 27.

Now the action of the adjusting device 2 which simultaneously serves as mechanical Modulo-2 mixer of the feedback shift register will be explained for the embodiment of FIGS. 4 to 6. The control elements $E_{18}$, $E_{19}$ and $E_{20}$, which are similar to the control elements Ex, Ey, Eo of FIG. 3, are not encumbered by final control elements and are freely adjustable. Final control element $S_{17}$ is associated with inner control element $E_{17}$ of the shift register output, final control element $S_1$ is associated with inner control element $E_1$ of the shift register input, while the information of tapping stage $E_A$, in the embodiment of FIG. 4 which corresponds to control element $E_3$, can be taken from final control element $S_3$. Analogous with the block schematic of FIG. 2, the information, i.e., the binary positions "zero" or "one" of the final control elements $S_{17}$ and $S_3$ are to be delivered to a Modulo-2 mixer whose output information adjusts the binary position of the control element $E_1$ of the shift register start.

Figure 8:
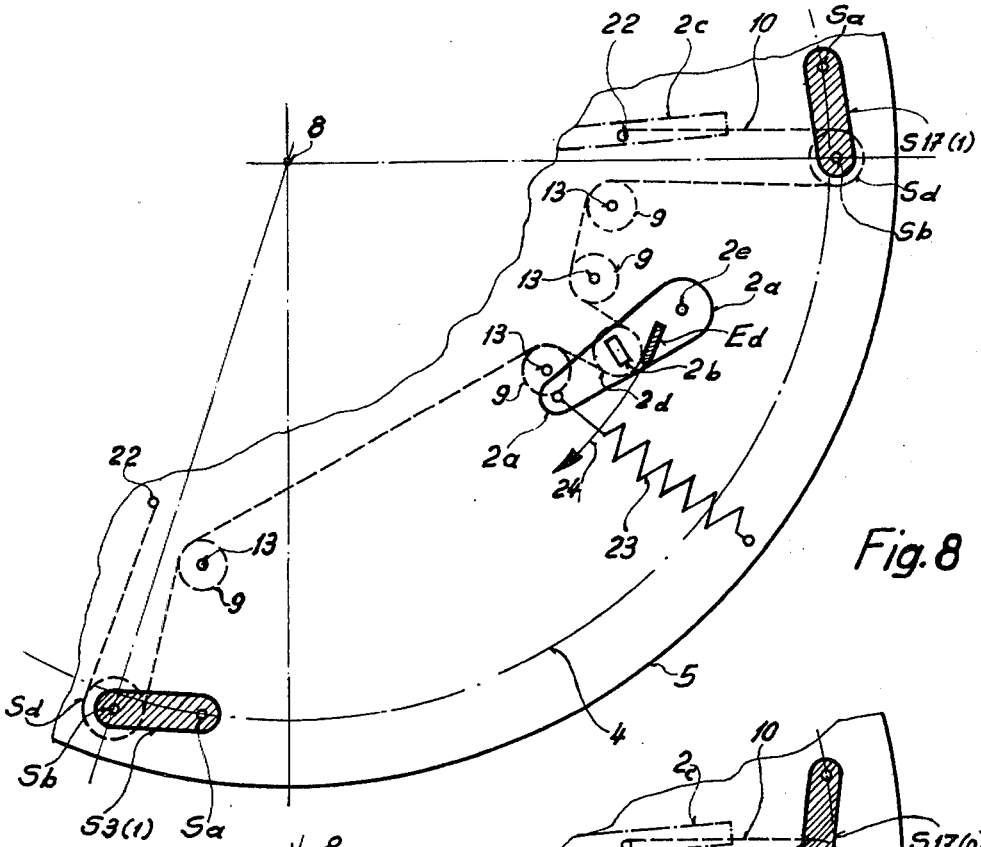
FIGS. 8, 9 and 10 each show a portion and a simplification of the sectional view taken on line C—C of FIG. 5 at a different operational phase (three different operational phases being shown).
Figure 9:
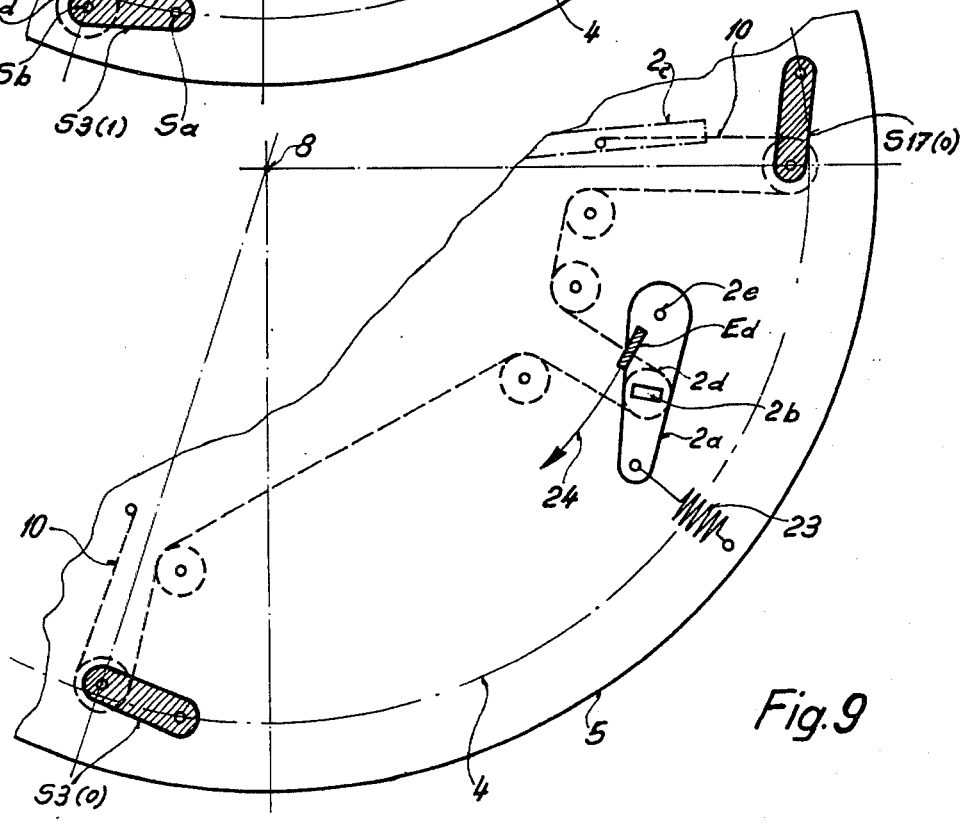
Figure 10:
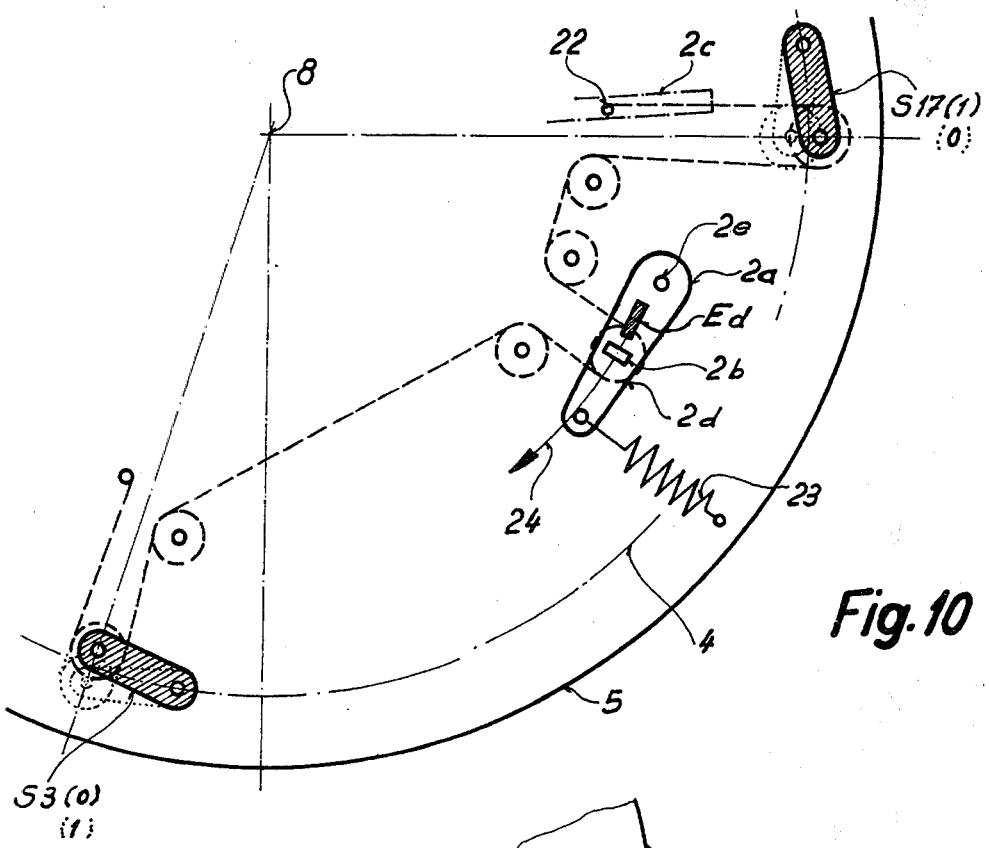

Referring to FIGS. 8 to 10, the Modulo-2 mixer which simultaneously acts as adjustment device 2, essentially consists of the zeroing stop $2_c$ fastened to stator 5 and the adjustment lever $2_a$. During rotation of rotor 1, the zeroing stop $2_c$ sets all control elements running past the stop to binary position "zero" by depressing the zero lever $E_c$. After passing the zeroing stop, a control element has binary position "zero" and during further rotation of the rotor runs past adjustment lever $2_a$.

The adjustment lever $2_a$ pivots about an axis of rotation $2_e$ fixed in stator 5 and is provided with an adjustment cam $2_b$. In an intermediate position (FIG. 10) of the adjustment lever $2_a$, the adjustment cam $2_b$ enters the circular path 24 of one-lever $E_d$ of the control elements whereby these are moved, by pushing the one-levers to the binary position "one" as shown in FIG. 5. The adjustment cam $2_b$ is outside a circular path 24 of the one-lever if the adjustment lever $2_a$ is in the outer position (FIG. 9) or in the inner position (FIG. 8). In both these cases, the control element running past the adjustment lever $2_a$ remains in the binary position "zero."

The position of adjustment lever $2_a$ is determined and controlled by the final control element $S_3$ of the shift register tap. This control is shown in FIG. 4 and shown in somewhat more detail for a better understanding in FIGS. 8 to 10 where those elements which are not required for a better understanding are omitted.

FIG. 8 shows that a string 10 is fastened to a fixed point 22 on the stator 5 and then runs as follows:

a. via the rope pulley $S_d$ of switch lever $S_{17}$;
b. via two deflection rollers 9 each with a roller axis 13 fixed on stator 5;
c. via a rope pulley $2_d$ rotatably mounted on the adjustment lever;
d. via two deflection rollers 9 each with a fixed axis of rotation 13;
e. via the rope pulley $S_a$ of switch lever $S_3$; and then with the second end of the string fastened to another fixed point 22 on the stator 5.

The string is kept taut by means of a tension spring 23 which acts on the adjustment lever $2_a$.

The relationship between the binary positions of the switch levers (or final control elements) $S_3$ and $S_{17}$ and the positions of adjustment lever $2_a$ is clearly indicated in FIGS. 8 to 10 and compiled in the following Table III for the four possible cases:

TABLE III

| Case | Switch Lever $S_3$ | Switch Lever $S_{17}$ | Adjustment Lever 2a | Shown in FIG. |
|---|---|---|---|---|
| 1 | binary position 0 | binary position 1 | middle position | 10 |
| 2 | binary position 1 | binary position 0 | middle position | 10 |
| 3 | binary position 0 | binary position 0 | outer position | 9 |
| 4 | binary position 1 | binary position 1 | inner position | 8 |

Cases 1 and 2 are both shown in FIG. 10, with the switch lever positions of case 2 shown by dotted lines. The one-levers $E_d$ are shown in cross section in FIGS. 8, 9, 10, plus the circular path 24 of these one-levers. In cases 1 and 2, the one-lever $E_d$ contacts the adjustment cam 2*b* of adjustment lever 2*a*, placing the associated control element $E_1$ in the binary position "one" (FIG. 10, view in FIG. 5).

In case 3 (FIG. 9) and in case 4 (FIG. 8), the one-lever $E_d$ travels past adjustment cam 2*b*, and the control element, which previously was set by the zeroing stop 2*c* to the binary position "zero" remains in position "zero."

Thus the relationship, shown in the Table IV below, results for the binary positions of final control elements $S_3$ and $S_{17}$ on the one hand and of the control element $E_1$ of shift register input.

TABLE IV

| Case | Binary Position Of $S_3$ | $S_{17}$ | $E_1$ |
|---|---|---|---|
| 1 | 0 | 1 | 1 |
| 2 | 1 | 0 | 1 |
| 3 | 0 | 0 | 0 |
| 4 | 1 | 1 | 0 |

It is evident that the described adjustment device 2 with the zeroing stop 2c and the adjustment lever 2a, controlled by the final control elements $S_3$ and $S_{17}$ acts as the Modulo-2 mixer whose output information determines the binary position of the inner control element $E_1$ of the shift register input. FIG. 5 shows the inner control element $E_{20}$ in a position where it is in the process of changing from binary position "0" to "1". This may require only so much angular path of the rotor as the final control elements $S_3$ and $S_{17}$ are still completely at binary position "zero" or binary position "one." After completing the change of inner control element $E_{20}$ and after shifting by one angular distance $\phi_t$, the control element newly set to "1" or left at "0" represents the control element $E_1$ of the shift register input.

In FIG. 4, the inner control elements $E_N$ have the same indices as the associated final control elements $S_N$. In order that the coincidence of indices is maintained even after shifting the rotor by one or several angular distances $\phi_t$, the index of the inner control elements may remain fixed in location and considered as an index of the information content, i.e., of the binary position of the register stage of a shift register.

Figure 7:
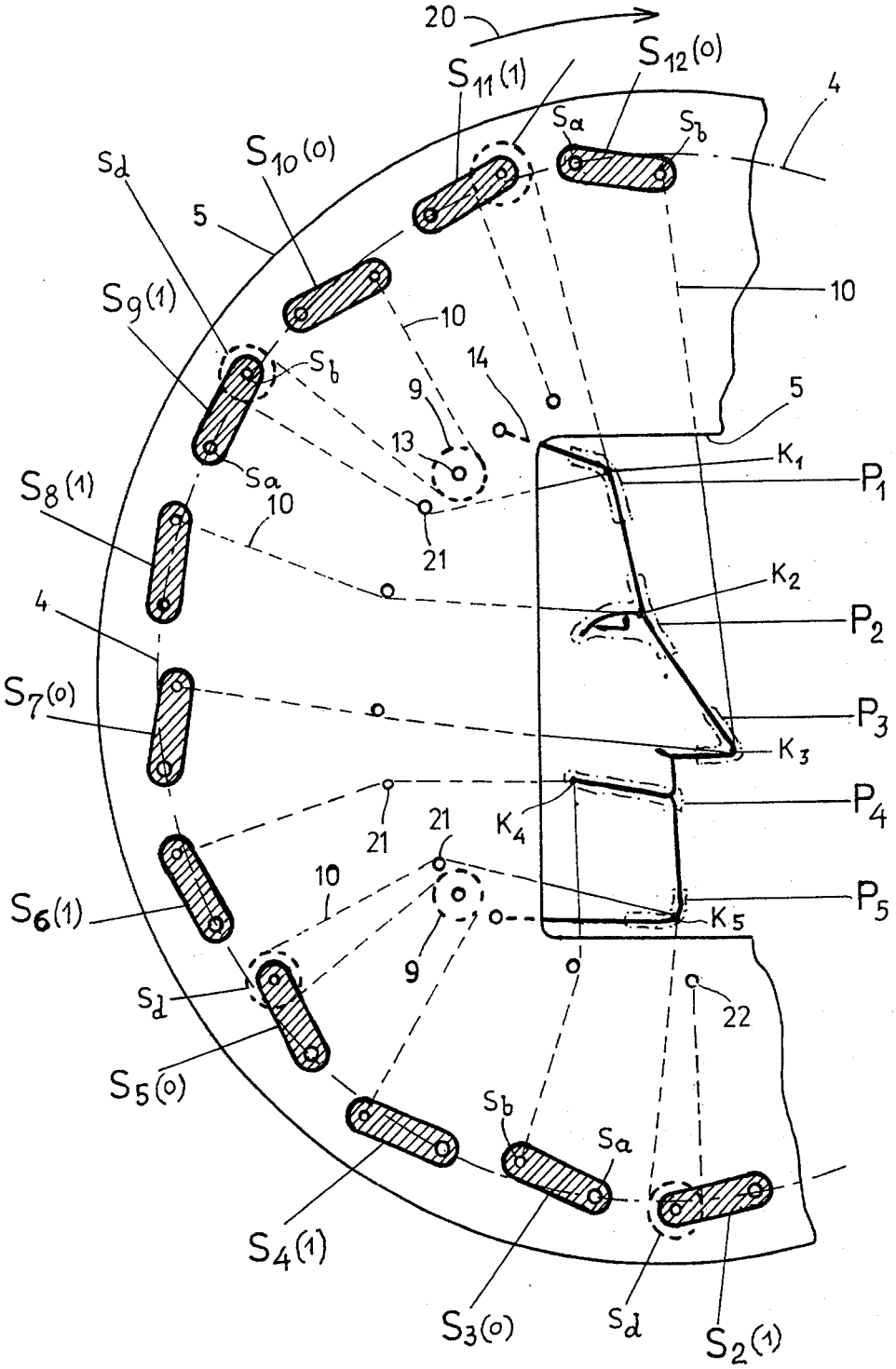
FIG. 7 shows a partial sectional view taken on line B—B of FIG. 5, similar to the left-hand half of FIG. 4, but in a different operational phase.

Referring to FIG. 7 which shows the left-hand half of FIG. 4, with the rotor 1 shifted or rotated from the FIG. 4 position through an angular distance $\phi_t$ in the direction of arrow 20. It is apparent that through this shift by a single angular distance, the picture consisting of picture elements $P_1$ to $P_5$ are changed completely.

If all 17 final control elements were connected via the connecting means with picture elements, then, while the rotor 1 runs through 131,071 shift steps or angular distances, there would result 131,071 pictures of the human face each of which is different from any other one and occurs only once.

If the apparatus were equipped with 31 instead of 17 register stages, then $2 \cdot 10^9$ different pictures of the face would occur or result, and each would occur only once.

In the embodiments described so far, the picture elements were parts of a coherent elastic string 14. Instead of the elastic string, a spring or an elastic foil with a drawing placed thereon might be used. Also, the picture elements may be portions independent of each other, which jointly produce the variable picture.

The inner control elements $E_N$ can be adjusted in any position of the rotor 1 by actuating the zero-lever $E_c$ by hand from one binary position to the other since the action levers $E_b$ with wedge-shaped chamferings $E_f$, and the rollers $S_c$ of the final control elements have a rounded roller edge $S_d$. This manual adjustability together with the display of the binary postion through the viewing holes $36_b$ allows the generation of any desired variable picture by hand.

Another possibility of maually changing the variable pictures consists in the differential shift of connecting means 10.

Referring now more particularly to FIG. 35, the movements of the connecting means 10 which controls the picture elements may be superposed on each other. The position of the picture element $P_4$ in this example depends on final control elements $S_2$ and $S_3$. On the one hand, final control element $S_2$ which with its own connecting means 10 directly controls picture element $P_5$, and, on the other hand, on final control element $S_3$ which with its own connecting means 10 is associated with the final control element $S_2$. A deflection eyelet 76 is mounted on the connecting means 10 which is moved by final control element $S_2$ and the connection means 10 which is connected with final control element $S_3$ passes through eyelet 76 and is guided thereby. The connecting means (10) which is moved by the final control element $S_3$ is guided to the picture element $P_4$. The mode of operation is such that a movement of picture element $P_4$ is the sum of motions of final control elements $S_3$ and $S_4$ and such operation provides the possibility of a differential change of the position of picture element $P_4$.

Figure 14:
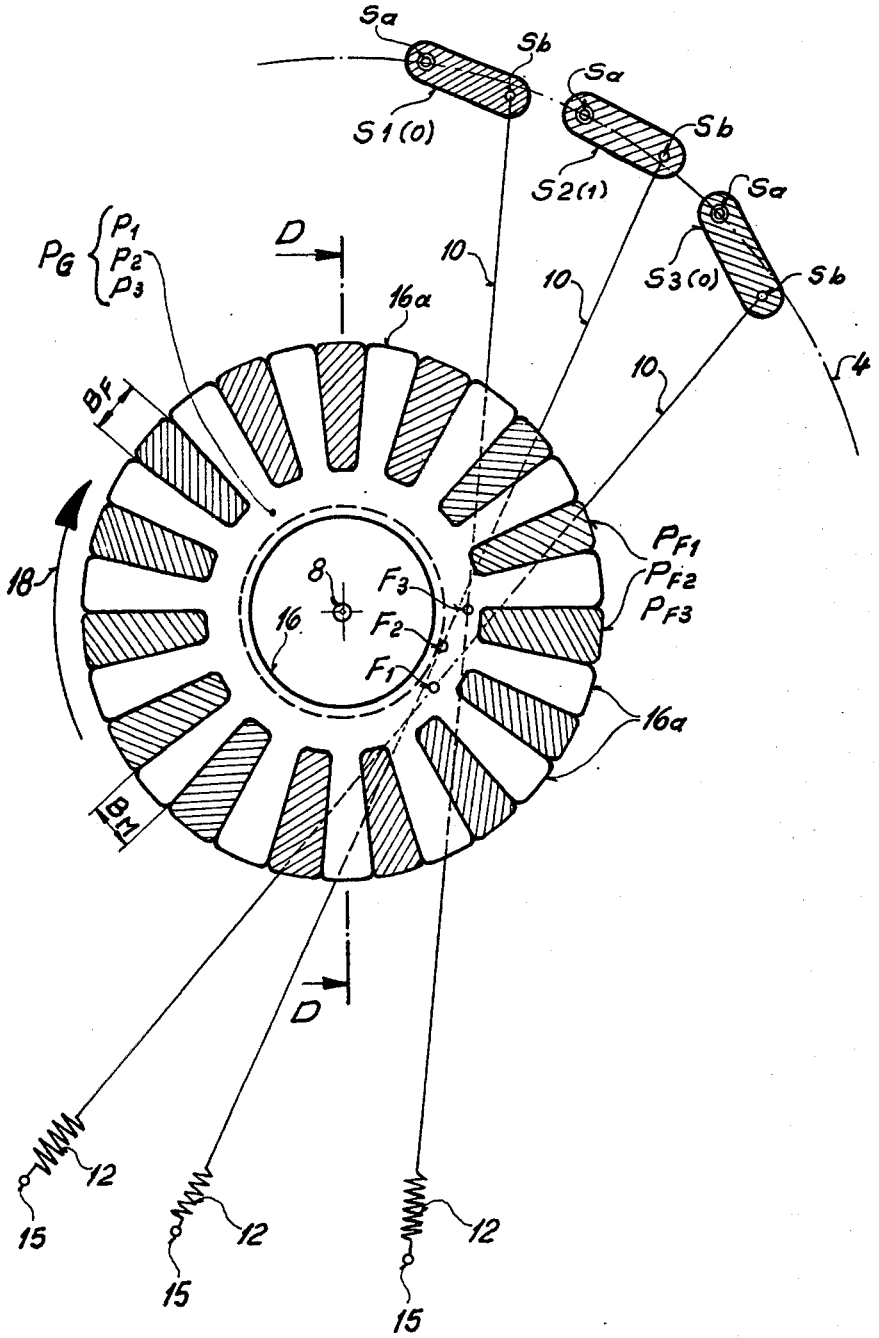
FIG. 14 is a top view of a portion of a picture element arrangement of another embodiment of the apparatus.

FIGS. 14 to 19 describe an embodiment of the apparatus in accordance with the present invention where the individual picture elements are mechanically independent of each other. FIG. 14 shows a simplified section of the embodiment of FIG. 4, with the picture elements contained in the elastic string of FIG. 4 replaced by colored foils which are separated from each other and pivotally arranged around the rotor center 8. The arrangement of final control elements, of the control elements, of the rotor and the whole construction of the apparatus of FIG. 14 may in principle be the same as that described by FIGS. 4 to 6, with the exception that a different type of picture elements are used. Of the final control elements located on the final control element circle 4, only three are shown which are used to explain this embodiment of the invention.

The other final control elements, as well as the other construction elements of the apparatus have been left out for the sake of simplicity and clarity.

Figure 15:
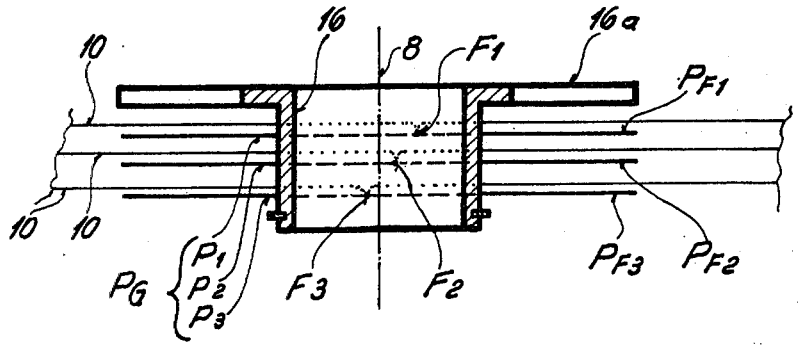
FIG. 15 is a sectional view taken along line D—D of FIG. 14.
Figure 19:
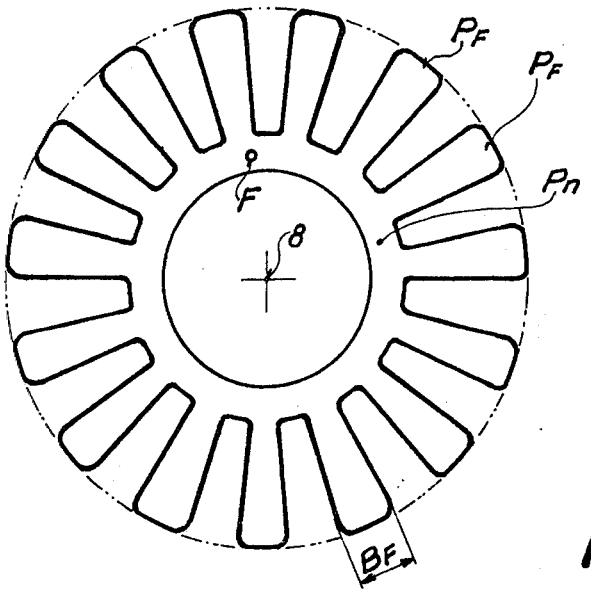
FIG. 19 shows a single picture element of the embodiment of FIG. 14.

The picture elements are again denoted by the letter P together with various indices or subscripts and the general notation for a picture element again being $P_n$. Referring more particularly to FIG. 19, an individual picture element $P_n$ of the type contained in the embodiment of FIGS. 14 and 15 and which consists of a thin colored foil. This foil has the form of a fan wheel, with a fan wheel center 8 and color parts $P_F$ or color wings $P_F$. The space between the color wings $P_F$ may be cut out or made from a transparent foil, as indicated by the dash-double dot circle. The hole F is used to fix or attach the picture element $P_n$ to the connecting means 10 which comes from or is associated with final control element $S_N$. As noted, this picture element $P_n$ is formed as a fan wheel foil with the connecting means being in the form of a string or a wire. The arrangement of FIGS. 14 and 15 has a foil group ($P_G$) formed from three adjacent fan wheel foils $P_1$, $P_2$, $P_3$ which are perpendicular to the foil plane, and which are arranged under the non-transparent cover masks 16a. These cover masks 16a are carried on a hub 16 which is rotatable about the axis 8. The three foils together with the connecting means 10 are shown in FIG. 15 spaced apart for the sake of clarity, while in actuality they are virtually in the same plane.

The cover masks 16a form the wings of a sort of fan wheel which is connected with hub 16. The cover masks 16a have approximately the same angle division as the color wings $P_F$ of the fan wheel foil $P_n$, and each cover mask is associated with a color wing. The width $B_F$ (See FIG. 14) of the color wings in the direction of color wing motion is the same size as the width $B_M$ of the cover masks. According to FIGS. 14 and 15, each of the three foils $P_1$, $P_2$, $P_3$ of foil group $P_G$ is connected via a connecting means in the form of a string 10 to an associated final control element. The foil $P_1$ is connected at connecting point $F_1$ to final control element $S_3$; foil $P_2$ is connected at connecting point $F_2$ to final control element $S_2$, and foil $P_3$ is connected at connecting point $F_3$ to final control element $S_1$.

Figure 16:
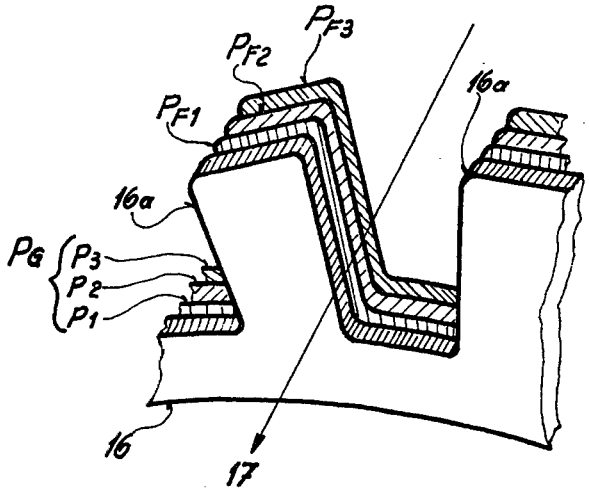
FIGS. 16, 17 and 18 each show partial perspective views of the embodiment of FIGS. 14 and 15, and each FIG. shows a different operational phase, three different operational phases being shown.
Figure 17:
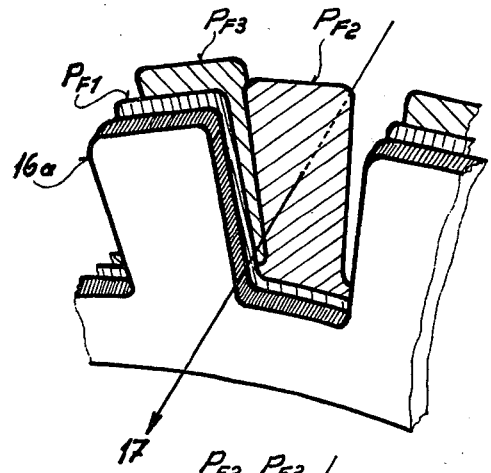

The three strings forming the individual connection means are kept taut by strings 12 fastened at support points 15. During the transistion of one of final control elements from one binary state to the other, the associated foil is pivoted about the wheel center 8 in such a way that in one of the binary states, the color wings $P_F$ in the view of FIG. 14 are covered by the non-transparent cover masks 16*a*, and in the other binary state they are located in the gaps between the cover masks. In FIG. 16, all three foils $P_1$,$P_2$,$P_3$ forming the foil group $P_G$ are drawn in a first identical binary state in which the color wings $P_{F1}$, $P_{F2}$, $P_{F3}$ are hidden behind the cover mask. The light which is directed in the direction of arrow 17 can pass without hindrance through the gaps between the cover masks and with white incident light all gaps between the cover masks viewed in the direction opposite to arrow 17 appear white. FIG. 17 shows the middle one of foils $P_2$ with the color wings $P_{F2}$ in the second binary state where the color wings are in the gaps between the cover masks. If these color wings $P_{F2}$ are, for example, yellow-transparent, yellow light then passes in the direction of arrow 17 through the gaps, and when viewed against the direction of arrow 17, all gaps between the cover masks appear yellow.

Figure 18:
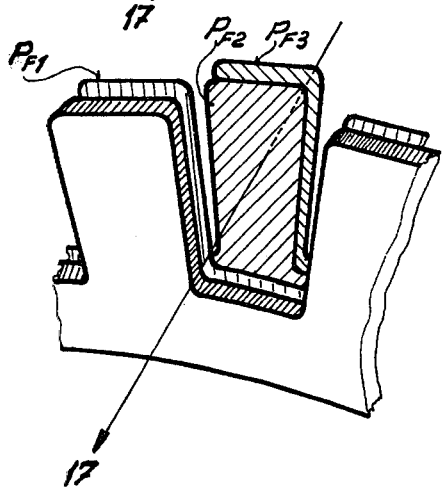

In FIG. 18, the two foils $P_2$ and $P_3$ with the color wings $P_{F2}$ and $P_{F3}$ are placed in the second binary state and the light shining through the gaps between the cover masks has the color which corresponds to a combination of color transparencies of color wings $P_{F2}$ and $P_{F3}$.

The various colors of the color wings are indicated in the figures by different shading.

Accordingly, if a color representation is to be obtained, it is particularly advantageous if in foil group $F_G$ of the three foils $P_1$, $P_2$, $P_3$ that the color wings of a first foil, for example, foil $P_{F1}$, are cyanic (bluish)-transparent; the color wings of the second foil, for example foil $P_{F2}$, are yellow-transparent; and the color wings of the third foil, for example foil $P_{F3}$, are magenta (purplish-red)-transparent. These three transparent colors are very common in photography and have the following transparencies for the three main colors red, green and blue;

cyanic: transparent for blue and green (blue-green)
yellow: transparent for red and green (yellow)
magenta: transparent for red and blue (red-blue)

Assuming that in the binary state "0" of the final control elements, the associated foils with their color wings are covered by the cover masks 16*a* (FIG. 16) and in binary state "1" of the final control elements, the associated foils with their color wings are located in the gaps between the cover masks, then the gaps between the cover masks for the eight possible combinations of binary positions of the three associated final control elements, viewed against the direction of arrow 17 in the colors listed in Table V below:

TABLE V

| Binary Position of Final Control Elements of Color Wing | | | |
|---|---|---|---|
| $P_{F1}$ | $P_{F2}$ | $P_{F3}$ | Color |
| 0 | 0 | 0 | White |
| 0 | 0 | 1 | Magenta or Reddish-Blue |
| 0 | 1 | 0 | Yellow |
| 0 | 1 | 1 | Red |
| 1 | 0 | 0 | Cyanic or Bluish-Green |
| 1 | 0 | 1 | Blue |
| 1 | 1 | 0 | Green |
| 1 | 1 | 1 | Black |

Hence, with three final control elements, each of which can assume two binary positions each, three successive color foils of a foil group $P_G$ acting as picture elements can be controlled so that in the eight possible combinations of binary positions, eight different transparent colors appear in the gaps between the cover masks. Instead of the color "black" it is also possible to develop a residual color, depending on the color transparence of the color foils used. The apparatus of FIGS. 14 to 16 is used to carry out the aforedescribed different color productions.

As is evident from FIG. 14, cover mask 16*a* having the width $B_M$ is alternately followed by a gap of width $B_F$ which is the width of the color wings $P_F$ of the foil $P_n$ and represents the picture element. The two widths $B_M$ and $B_F$ are equal.

The variable picture comes about by the joint action of three colored foils $P_n$ acting as picture elements and consists of the totality of the light shining through the gaps between the cover masks. The picture is similar to the petals of a flower which can take on eight different colors. A disadvantage of this embodiment is that the area of the invariable cover masks is virtually identical with the area of the gaps between the cover masks which together constitute the variable picture. Hence, the variable picture includes only about half the total area.

Figure 21:
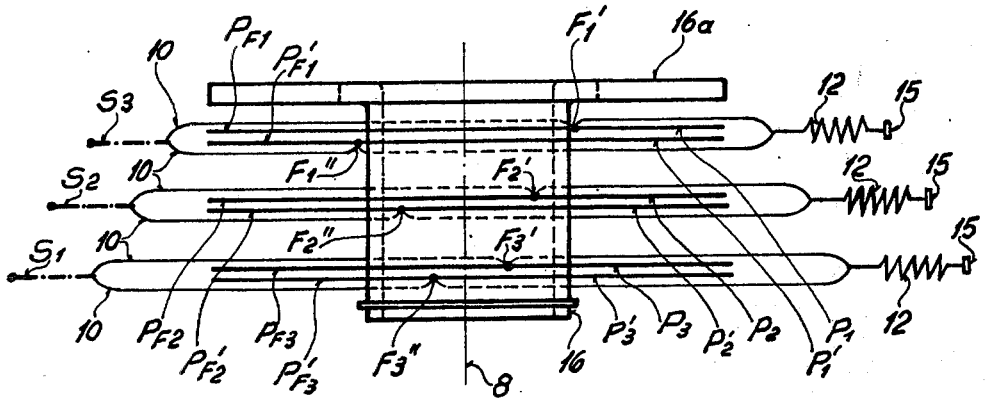
FIG. 21 shows a side view as viewed in the direction of arrow G of FIG. 20.
Figure 20:
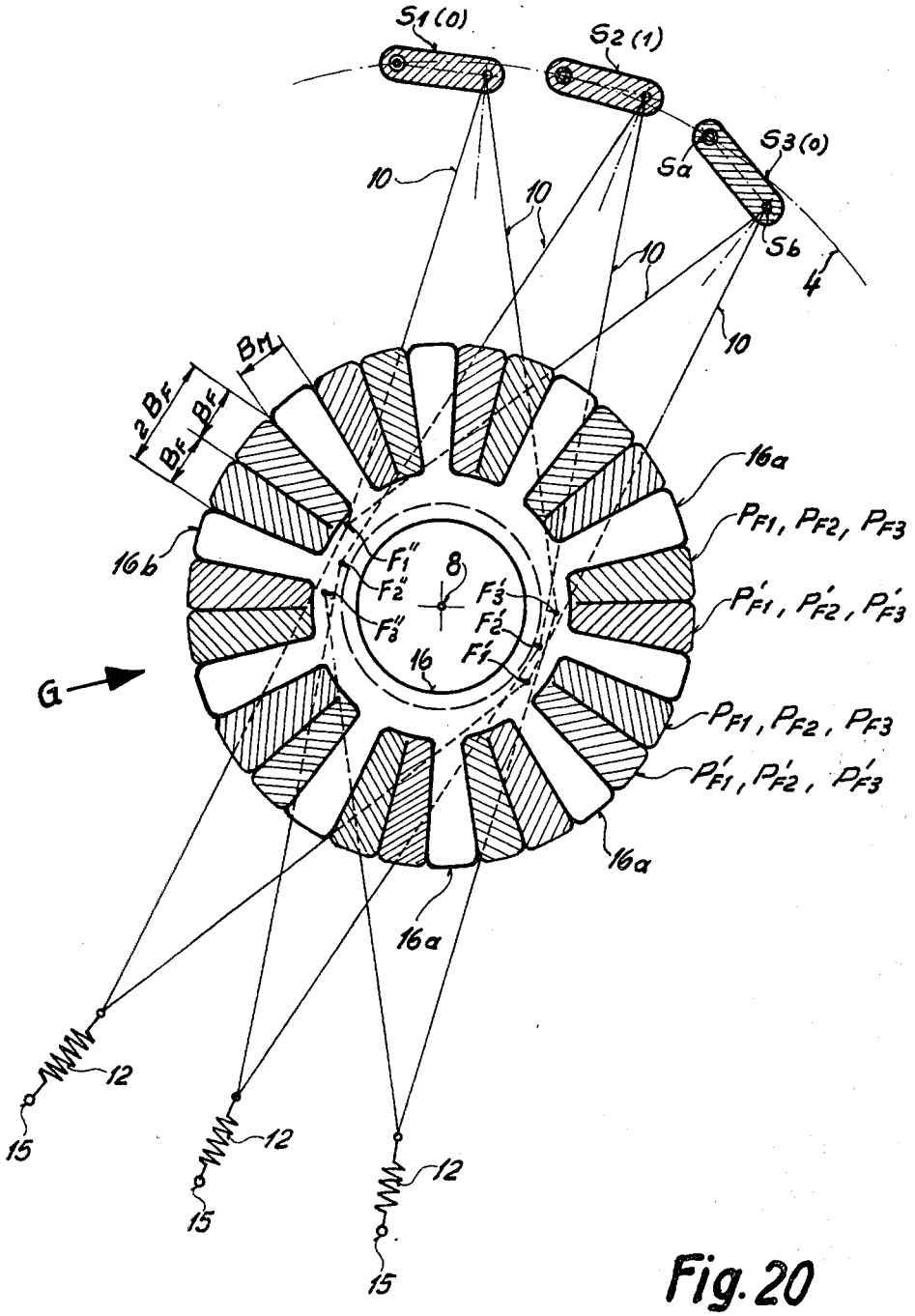
FIG. 20 shows a top view of a portion of a picture element arranged according to another embodiment of the apparatus.

Referring to FIGS. 20 and 21 of the drawings, an embodiment is shown in which the area of the invariable cover masks is one-third of the total area and only half the area of the variable picture. The gaps between the cover masks are about twice as wide and the variable picture takes about two-thirds of the total area, instead of only one-half, as in the embodiment of FIGS. 14 and 15.

Again, there is a foil group whose foils are located behind one another and which have three different transparent colors cyanic, yellow and magenta, with a foil pair ($P_F$, $P'_F$) comprising two identical-colored fan wheel foils which are available for each of the three colors. The two foils of a foil pair, for example, of foil pair $P_{F1}$,$P'_{F1}$ are moved by the same final control element. For example, for the final control element $S_3$ pivot foils $P_{F1}$ and $P'_{F1}$ about the axis 8 by a separate connecting means 10 for each foil $P_{F1}$ and $P'_{F1}$. And foil $P_{F1}$ and $P'_{F1}$ are pivoted in directions opposite to each other. This is accomplished because the two separate connecting means 10, for example, for the foils of foil pair $P_{F1}$, $P'_{F1}$ are connected to them at connecting points $F'_1$ and $F''_2$, respectively, which are diametrically opposite with respect to axis 8. In the binary position "zero" of a final control element, for example, final control element $S_3$, the color wings, for example, $P_{F1}$, $P'_{F1}$ of the associated foil pair are covered by the cover masks. When the final control element changes to binary position "1", the color wings $P_{F1}$ of the one foil of the foil pair, with connection point $F'_1$ move counterclockwise (FIG. 20), and the color wings $P'_{F1}$ of the other foil of the foil pair, with connection point $F''_1$, move clockwise by the width $B_F$ of the color wings which corresponds to the width $B_M$ of the cover masks. The gap between two cover masks is twice the width ($2B_F$) and is filled with the motion amplitude of only the single path $B_F$ by the identically colored foils of a foil pair. The color wings $P_{F1}$, $P'_{F1}$ of the first foil pair are, for example, cyanic transparent. The color wings $P_{F2}$, $P'_{F2}$ of the second foil pair are yellow transparent and are connected at connection points $F'_2$, $F''_2$ by means of an individual connecting means 10 to the associated final control element $S_2$.

The color wing $P_{F3}$, $P'_{F3}$ of the third foil pair are magenta transparent and are connected at connection points $F'_3$, $F''_3$ via connecting means 10 to the associated final control element $S_3$. The color wings $P_{F1}$, $P'_{F1}$ are associated with and relate to the color foils $P_1$, $P'_1$; the color wings $P_{F2}$, $P'_{F2}$ are associated with and relate to the color foils $P_2$, $P'_2$, and the color wings $P_{F3}$, $P'_{F3}$ are associated with and relate to the color foils $P_3$, $P'_3$.

The embodiment according to FIGS. 20 and 21 is constructed in a manner similar to that of FIGS. 14 to 19. In a manner analogous to FIG. 15, FIG. 21 is drawn axially exploded so as to make it more readily and easily understood.

Figure 22:
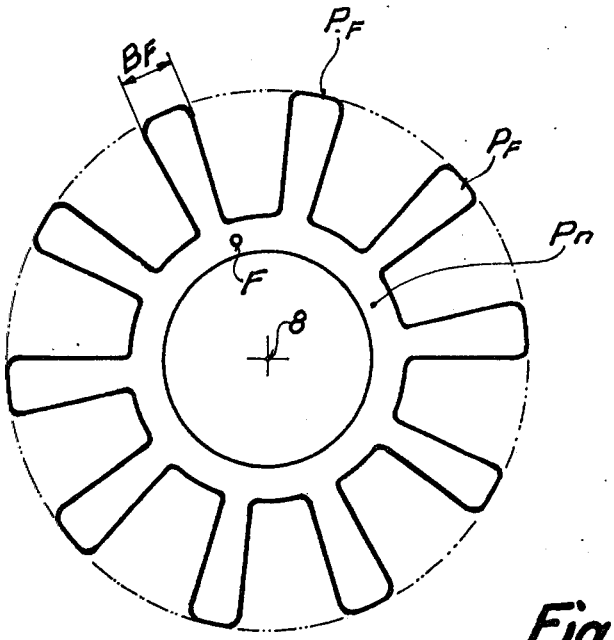
FIG. 22 shows a single picture element of the embodiment of FIG. 20.

As best seen in FIG. 22, a single color foil is used as picture element $P_n$, this picture element provided with color wings $P_F$ for the embodiment of FIGS. 20 and 21.

The number m of cover masks 16a, and the number of color wings $P_F$ are always equal to each other. In the embodiment of FIG. 14, m=15; and in the embodiment of FIG. 20, m=10.

Because a foil pair was formed for each of the three colors in FIG. 20, the area of the variable picture could be increased to two-thirds of the total picture area.

In the case of FIGS. 14 to 19, three color wings $P_{F3}$ are located behind one cover mask 16a, and in the case of FIGS. 20 to 22 six color wings are located behind the same cover mask.

According to FIG. 20, a principal group of foils is formed from the three foil pairs together with color wings ($P_{F1}$, $P'_{F1}$), ($P_{F2}$, $P'_{F2}$) and ($P_{F3}$, $P'_{F3}$).

To further enlarge the area of the variable picture, instead of one (n=1), two (n=2) or n such principal groups of foils can be used: each principal group has 3 foil pairs with a total of 3×2=6 foils with m color wings each, hence (3×2×m) color wings. The total (3×2×m×n) color wings are coverable behind m cover masks. Of the n principal groups, the color foils of the first principal group are moved through the single amount $B_M$ by the final control elements; the single amount $B_M$ is the width of one cover mask. The second principal group is moved by double the amount $B_M$ and, that of the n-th principal group by the n-fold amount of width $B_M$ of a cover mask.

Figure 23:
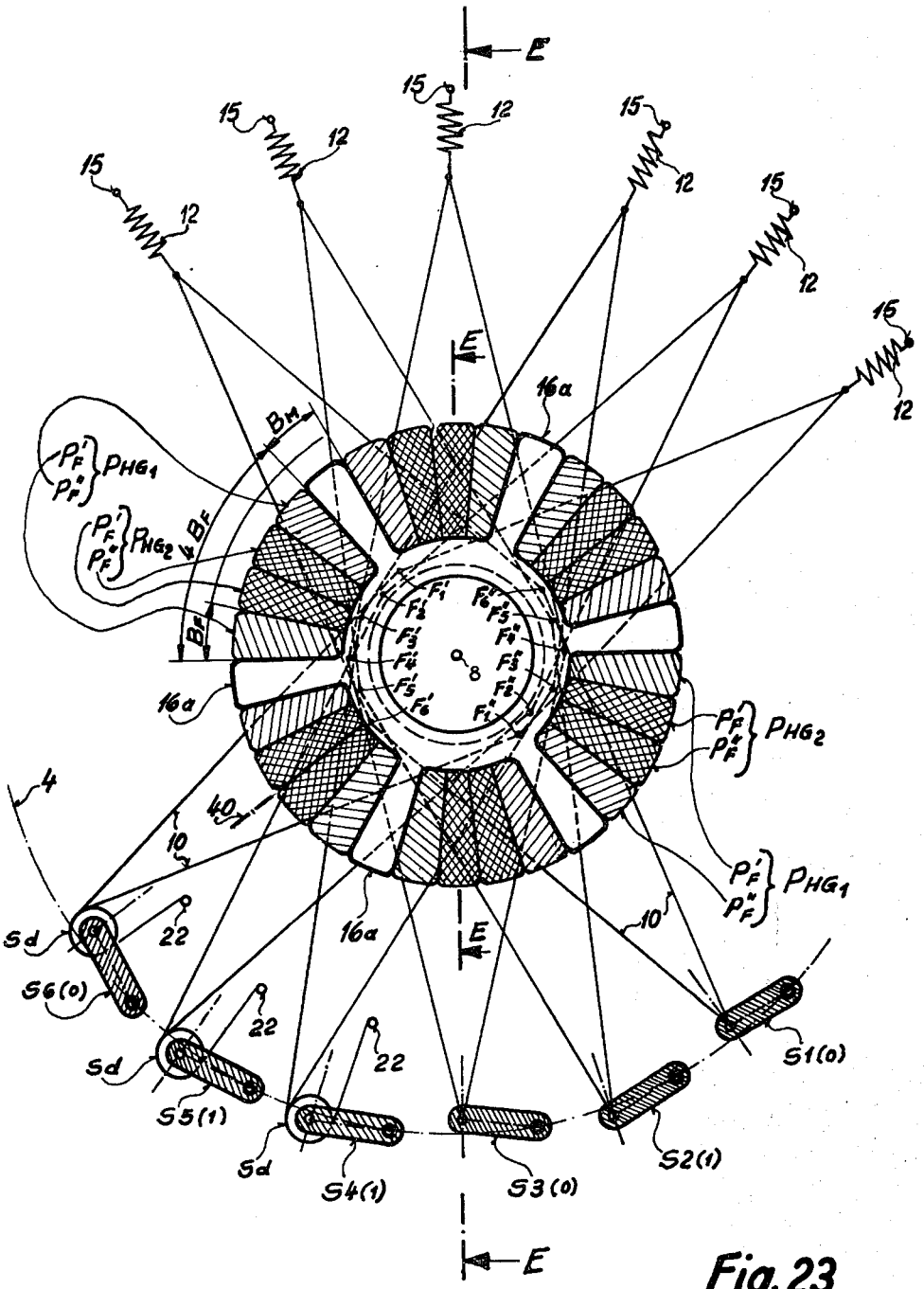
FIG. 23 is another embodiment of the apparatus. This FIG. shows a top view of portion of a picture element arrangement of this embodiment of the apparatus.
Figure 24:
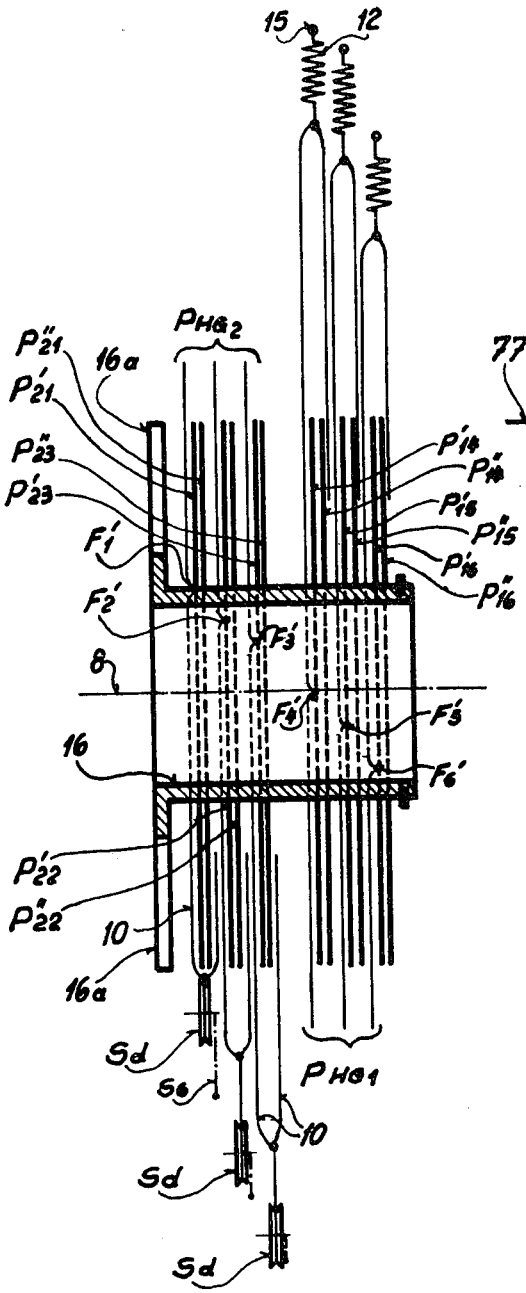
FIG. 24 shows a sectional view taken along line E—E of FIG. 23.
Figure 25:
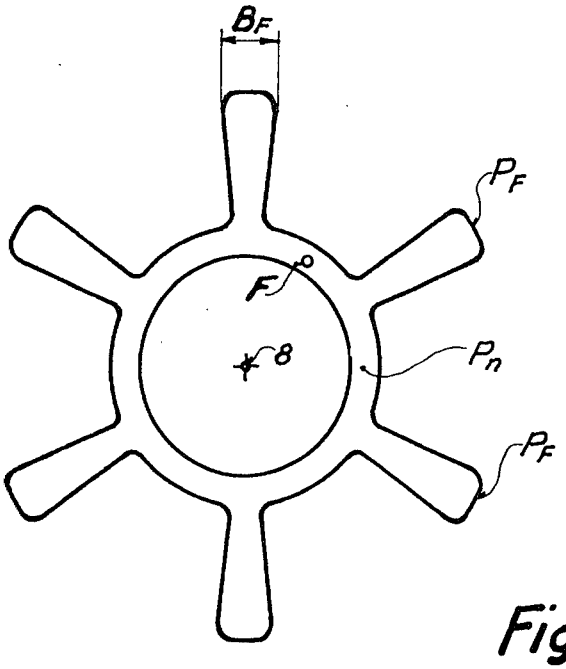
FIG. 25 shows an individual picture element.

FIGS. 23 to 25 show an embodiment with n=2, and with two principal groups $P_{HG1}$ and $P_{HG2}$ with a construction and operation similar to those shown in FIGS. 20 to 22. The first principal group $P_{HG1}$ of FIGS. 23 and 24 corresponds to the (single) principal group of FIGS. 20 to 22 whose color foils are associated with the final control elements $S_1$, $S_2$, $S_3$, and is movable by them by the single amount of width $B_M$ of cover masks 16a, and here also width $B_M$ is equal to width $B_F$ of the color wings. The color wings of the first principal group $P_{HG1}$ are shown in FIG. 23 with a single diagonal line of simple shading.

The color foils of this first principal group $P_{HG1}$ with the foil paris ($P'_{14}$, $P''_{14}$), ($P'_{15}$, $P''_{15}$), ($P'_{16}$,$P''_{16}$) whose color wings are denoted in FIG. 23 jointly by $$\left.\begin{matrix} P_{F'} \\ P_{F''} \end{matrix}\right\} P_{HG1}$$

are connected at their connection points ($F'_4$, $F''_4$), ($F'_5$, $F''_5$) and ($F'_6$, $F''_6$) via the connecting means 10 directly to the final control elements $S_1$, $S_2$, $S_3$.

The color foils with the foil pairs ($P'_{21}$, $P''_{21}$), ($P'_{22}$, $P''_{22}$), ($P'_{23}$, $P''_{23}$) whose color wings in FIG. 23 are denoted jointly by $$\left.\begin{matrix} P_{F'} \\ P_{F''} \end{matrix}\right\} P_{HG2}$$

form the second principal group $P_{HG2}$ and are moved by the associated final control elements $S_4$, $S_5$, $S_6$ via connecting means 10 and the connection points ($F'_1$, $F''_1$), ($F'_2$, $F''_2$), ($F'_3$, $F''_3$).

The foils of this second principal group are moved by an amount which is double the amount of the width $B_M$ of cover masks 16a so that they are located in a mid-position between the cover masks. The color wings of the second principal group $P_{HG2}$ are shown cross-hatched using two diagonal lines in FIG. 23. The movement by the double amount of width $B_M$ is achieved by fastening the connecting means 10 with one end to a fixing point 22 on stator 5, and, after a 180° wrap around the roller $S_d$ mounted on final control element $S_n$, by attaching to the connecting points of the foil.

FIG. 25 shows a single color foil $P_n$ for the embodiment of FIGS. 23 and 24.

The color foil contains five color wings $P_F$, the same as the number of cover masks 16a (m=5). With (n=2) principal groups, (m=5) cover masks and (m=5) color wings per color foil, 3 pairs of color wings per principal group, there are a total of 3·2·2·5=60 color wings which are covered by (m=5) cover masks 16a. As shown in FIG. 23, the total area includes 4 areas $B_F$ and one area $B_M$. Therefore, the area of the variable picture is about four-fifths of the total area, as the gaps with width (4 $B_F$) between the cover masks 16a correspond to about four times the width $B_M$ of the cover masks.

The color wings located in such a gap and determining the color together form a picture which is similar to a petal.

The variable picture shown in FIG. 23 can be interpreted as a flower with five petals of width 4 $B_F$. These petals appear one to two colored, and the petals are always symmetrical to the petal axis 40.

Figure 26:
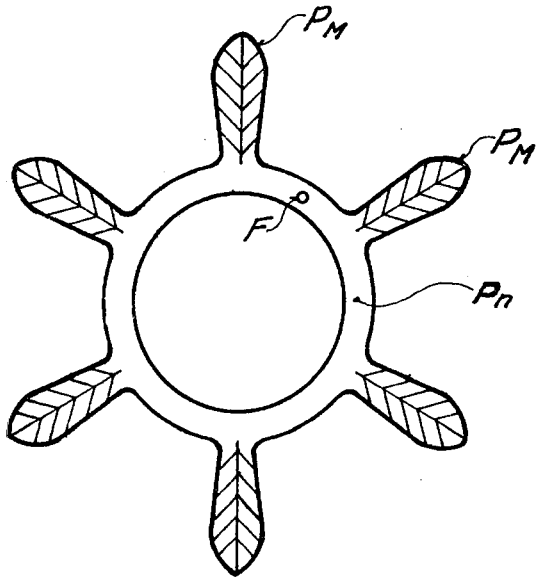
FIG. 26 shows another picture element of the embodiment of FIG. 23.

Individual picture elements $P_n$, for example according to FIG. 25, may also be wings $P_M$ instead of color wings $P_F$; these wings $P_M$ have line drawings and are called line foils, as indicated by FIG. 26.

In the embodiment of FIG. 23, the color foils used as picture elements are controlled by the binary positions of six final control elements $S_1$ to $S_6$, and it is possible to generate or produce $2^6=64$ different pictures of a flower. If 2 pairs of line foils according to FIG. 26 were added, each controlled by a final control element, then it is possible to produce $2^8=256$ different pictures of flowers.

A first device of this nature might be provided with large foils and large diameter of hub 16, and a second one with small diameter, concentric with the first which can be placed inside hub 16 of the first device. The combined device would be controlled by 16 final control elements which would result in a total of $2^{16}=65{,}536$ different pictures of flowers.

The color foils normally are made of thin plastic foils. Instead of the color foils, thin colored glass may be used.

With the embodiments described by in FIGS. 14 to 26, the generated variable pictures are to be viewed under a transparency light. The devices are suitable for attaching to windows or dwellings or to light fixtures or lamps. The circular ring body or rotor 1 may be driven by hand or it may be motor-driven. The device may also be coupled to a clock, preferably a clock with hands; when a clock is used, the clock motor also drives rotor 1. Such a clock arrangement is shown in FIG. 32 which only shows the view as seen from the outside. The device contains a rotor with control elements, associated final control elements which are connected via connecting means to the picture elements $P_{n1}$, $P_{n2}$, and $P_{n3}$; the device may be similar to the device of FIG. 4. The picture elements $P_{n1}$ jointly form the variable picture of a human face in a manner similar to that of FIG. 4 or FIG. 7. The picture elements $P_{n2}$ and $P_{n3}$ may be similar to the picture elements of FIG. 23 or FIG. 31 and could jointly represent the variable picture of a flower. The clock includes hour indicators and conventional time-indicating hands 60 and 61 which are concentric with rotor axis 8, and are also concentric with the variable flower picture.

Figure 28:
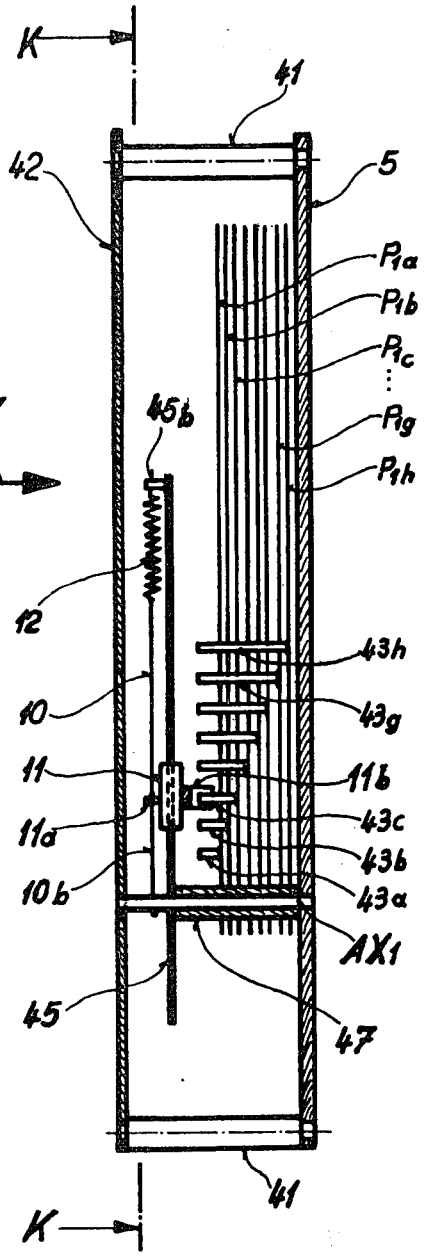
FIG. 28 is a sectional view taken along line I—I of FIG. 27.
Figure 27:
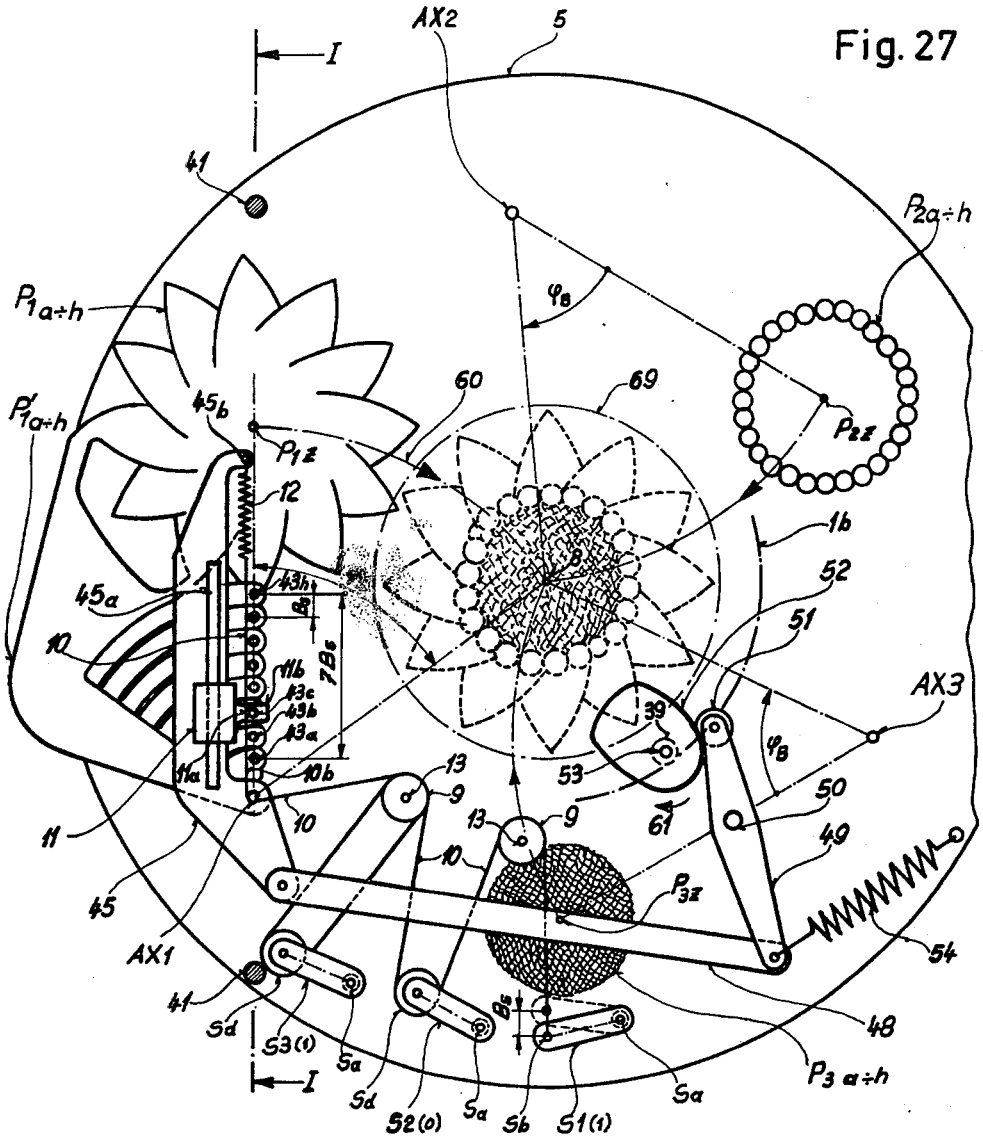
FIG. 27 shows another embodiment of the invention. This embodiment is similar to the embodiment of FIG. 4, but with different picture elements.

Referring now more particularly to FIGS. 27 and 28 which show an embodiment where individual picture elements can be selected from groups of picture elements by selecting devices 11, and the selecting device consists of a selection slide 11 which can be moved by final control elements $S_N$ via connecting means 10. The selection slide 11 slides on a guide portion 45 in a guide slot 45*a*, and the guide portion 45 pivots about an axis $AX_1$. In the example, when n=3, 8 picture elements $P_{1a}$, $P_{1b}$, $P_{1c}$ . . . $P_{1n}$ can be selected by the $2^n=2^3=8$ possible combinations of positions for the n=3 final control elements $S_1$, $S_2$, $S_3$.

The final control elements consist of the pivotable switch levers and can assume two binary positions ("0" and "1") where their movable ends $S_b$ traverse the unit path $B_s$ when changing from one binary position to the other. The connecting means 10 from the final control elements to the selection device is fastened to final control elements $S_1$, and the connection means 10 is guided via the deflection roller 9 and rope pulley $S_d$ from final control element $S_2$ to a second deflection roller 9 and from there via another rope pulley $S_d$ from final control element $S_3$ to an additional deflection roller 9, to an additional rope pulley $S_d$ from final control element $S_3$ to an additional deflection roller 9, and from there after deflection about axis $AX_1$ is fastened at end 10*b* to the bolt 11*a* of the selection slide 11.

By means of tension spring 12, which acts on the selection slide 11, the entire string drive with connecting means 10 is kept taut. The motion of final control element $S_1$ is transmitted with simple motion amplitude (1 $B_s$); the motion of final control element $S_2$ is transmitted with double or twice the motion amplitude (2 $B_s$); and, the motion of final control element $S_3$ is transmitted with four times the motion amplitude (4 $B_s$) to the end 10*b* of the connecting means, and hence the motion of the control elements $S_1$, $S_2$ and $S_3$ is transmitted to the selection slide 11. The maximum motion of the selection slide for n=3 final control elements, therefore, is $B_s=7$ $B_s$ according to the above formula $2^n-1=2^3-1=7$.

The selection slide 11 may assume $2^3=8$ different positions for the $2^3=8$ possible position combinations of n=3 switch levers which are spaced apart by the unit path $B_s$. In each of these 8 different positions, an engaging member 11*b* is engaged to one of the 8 engaged members (43*a* to 43*h*) of the 8 different picture elements $P_{1a}$ to $P_{1h}$. The engaging member 11*b* is constructed as a fork, and the engaged members 43*a* to 43*h* are constructed as bolts which are fastened to the associated leaflike picture elements. These leaflike picture elements are arranged pivotally about axis $AX_1$.

In FIGS. 27 and 28, the position of the final control elements are as follows:

final control element $S_1$ is in binary position "1",
final control element $S_2$ is in binary position "0",
final control element $S_3$ is in binary position "1".

And, accordingly the engaging member 11*b* of selection slide 11 is engaged with engaged member 43*c* of picture element $P_{1c}$.

The embodiment of FIG. 27 may have an annular rotor with internal teeth 1*b*, similar to that of FIG. 4. The annular rotor is driven by a drive made via a crankshaft 53 and a gear 39 such that one revolution of the crankshaft corresponds to the motion of the rotor through one angle division $\phi_t$. The crankshaft 53 has mounted thereon one cam disk 52 which can turn the guide portion 45 through the angle $\phi_B$ about the axis $AX_1$ by means of lever 49 which has a fixed axis at 50 and a roller 51 connected at one end of the lever 48 and via connecting rod 48 pivotally connected to the other end of lever 49. The cam disk is rotated in the direction of arrow 61 (clockwise as shown) and is shown in a position where the final control elements have just taken on their new position from the control elements and have adjusted the selection device accordingly, which position remains during the subsequent half rotation of the cam disk 52. During this half rotation, the selected picture element ($P_{1c}$) is rotated through the angle $\phi_B$ to a picture region 69 located in the center.

This picture region 69 is shown in FIG. 27 bordered by a large dash and a dot line. The picture elements turned into the picture region are drawn with broken lines, and the picture elements in the non-rotated position are shown by solid lines. Within the picture region circle (FIG. 27), the picture elements are visible in the top-view direction according to arrow 77 of FIG. 28, while in the unrotated position outside the picture region they are covered by the cover metal sheet 42. The picture elements may be of thin sheet metal or foils, and each picture element may have a color different from the others and have different shapes. In FIG. 28, the picture elements $P_{1a}$ to $P_{1h}$ are drawn apart for the sake of clarity, while in reality they are virtually on top of each other. The picture elements of group $P_{1a}$ to $P_{1h}$ (upper left hand of FIG. 27) have the shape of a petaled blossom and are connected via connecting parts $P'_{1a}$ to $P'_{1h}$ to the pivot axis $AX_1$.

FIG. 27 in the upper right hand portion shows a second picture element group $P_{2a}$ to $P_{2h}$ whose picture elements can be pivoted about an axis $AX_2$ through the angle $\phi_B$ into the picture region 69; and, there is another similar, third picture element group with picture elements $P_{3a}$ to $P_{3h}$ and pivot axis $AX_3$. The picture elements of these two picture element groups are each selected by 3 additional final control elements; each picture element group is selected with a separate selection device 11, and each picture element group turned by means of a cam drive. The selection device and the cam drive while not shown in FIG. 27 are the same as for the first picture element group. In the picture region, the three picture elements which are each selected from one picture element group all come to lie on top of one another, and they together form the variable picture; and, in this example the variable picture formed is a picture of a flower.

In accordance with the three groups of eight different picture elements $8^3=512$ different pictures of flowers can be produced.

Figure 29:
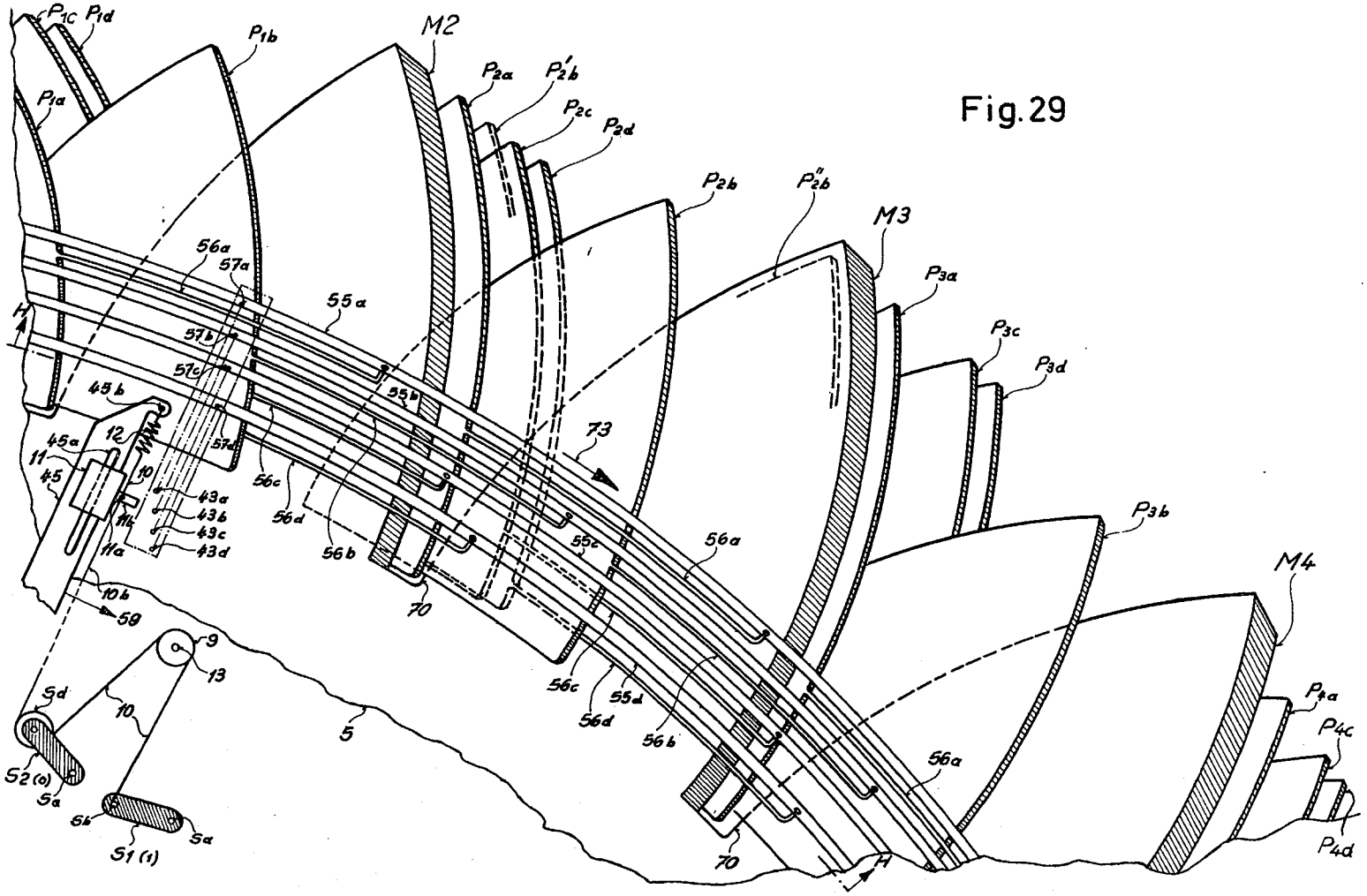
FIGS. 29 to 31 show another embodiment of picture elements.
Figure 30:
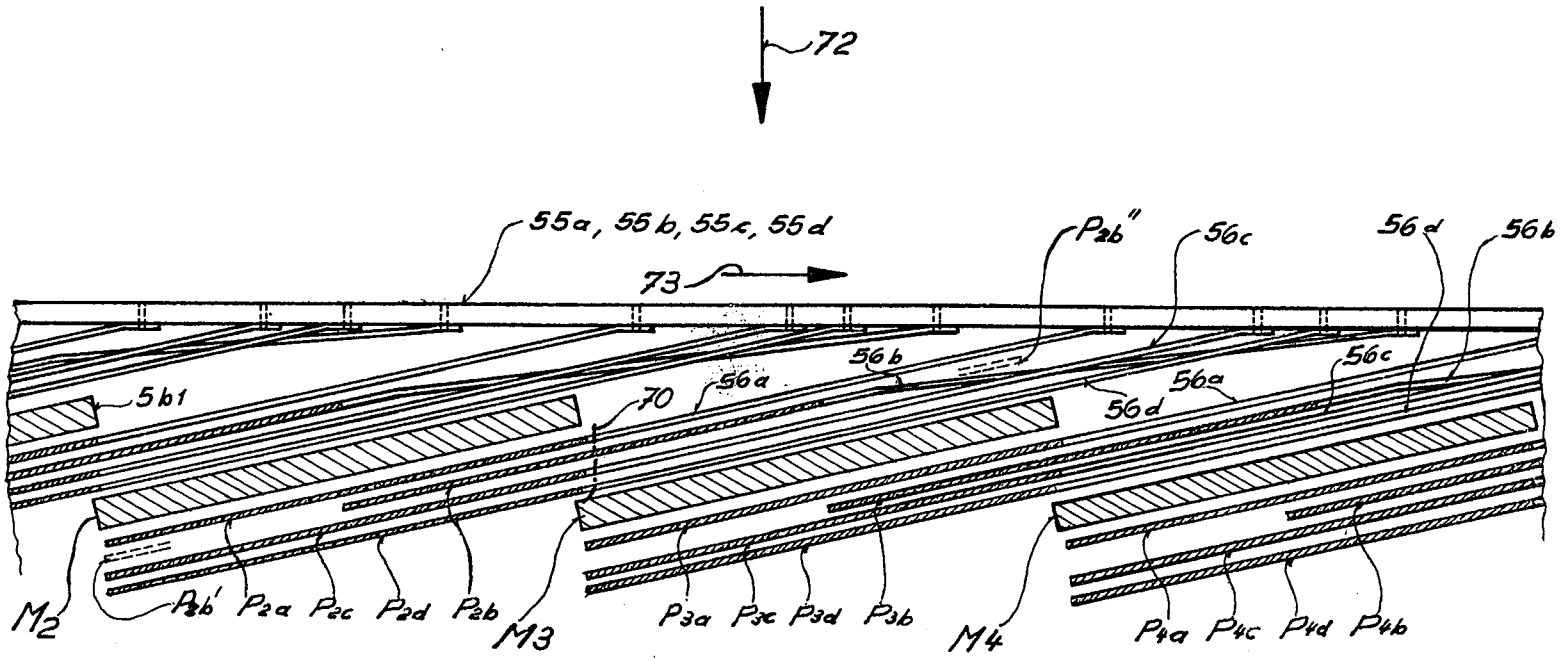
Figure 31:
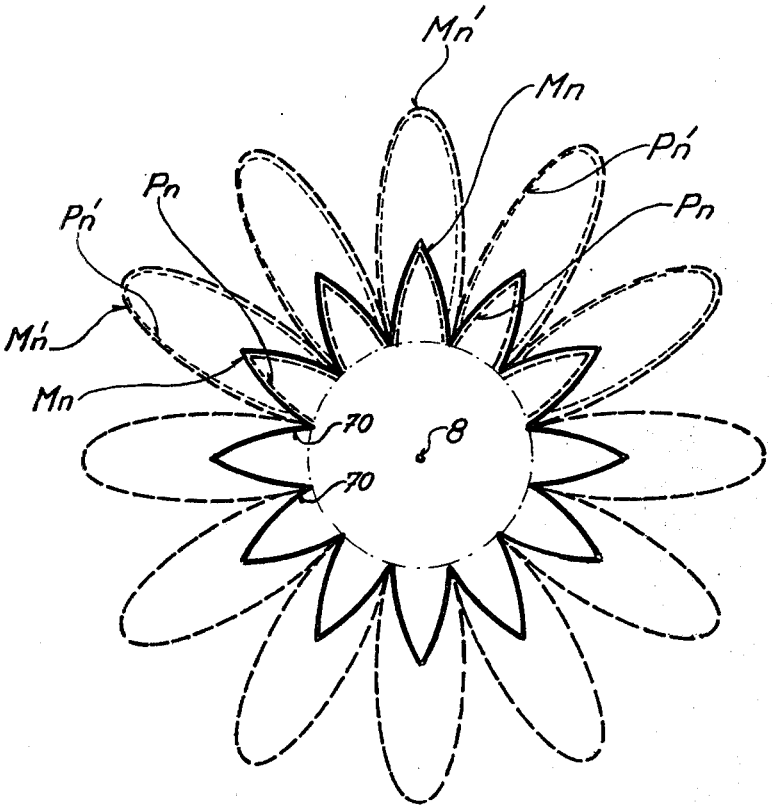
Figure 32:
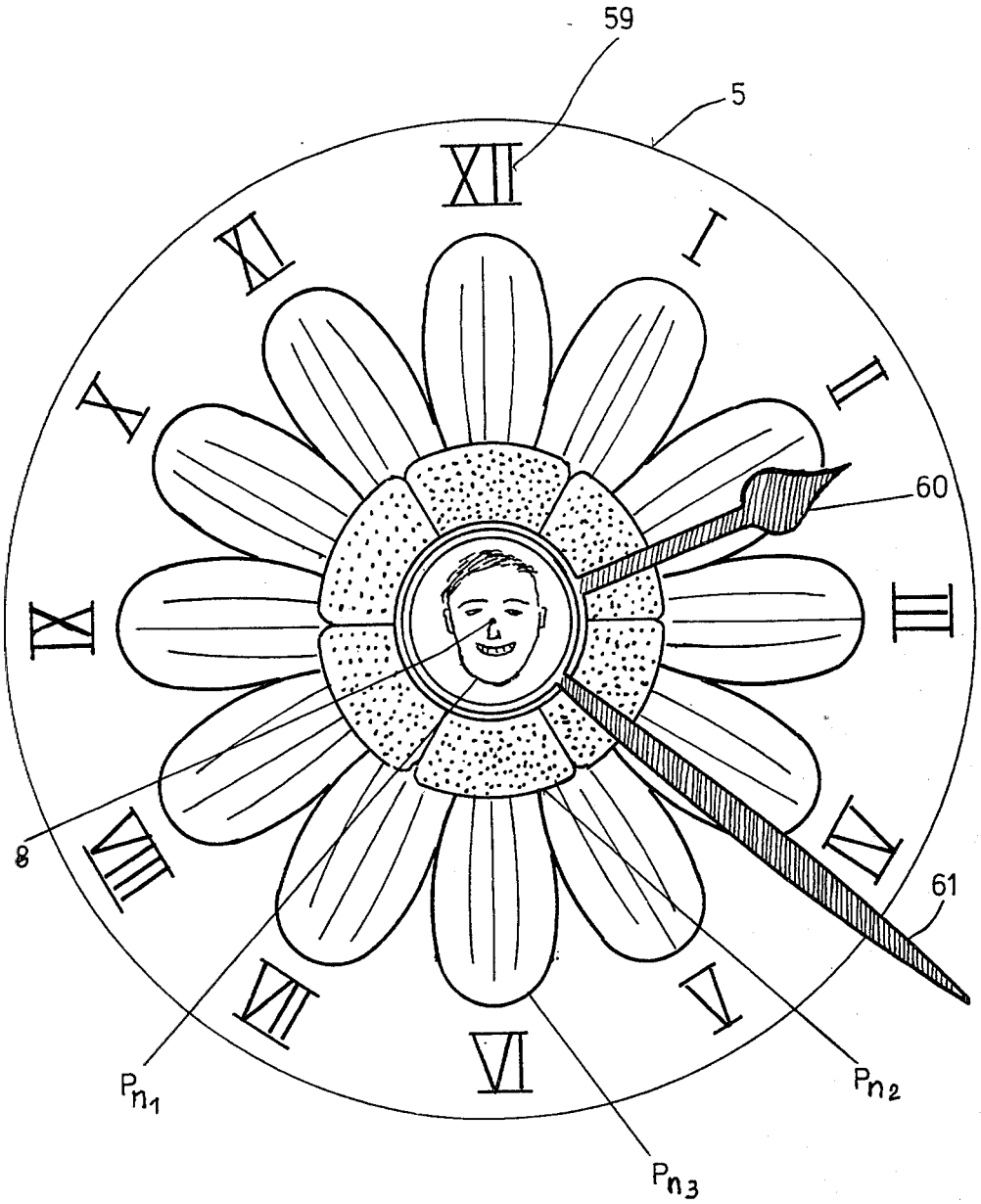
FIG. 32 shows a simplified view of another embodiment.

FIGS. 29 to 31 show another embodiment of the invention in which there are four picture elements $P_a$, $P_b$, $P_c$ and $P_c$ which can be selected by means of a selection device may in turn be divided into sub-elements. All of the sub-elements of a picture element are jointly selected by the selection device and are connected to one another. For example, picture element $P_a$ includes the sub-elements $P_{1a}$, $P_{2a}$, $P_{3a}$, $P_{4a}$ . . . which are connected together by means of a connecting rail 55*a* and connecting webs 56*a*. Picture element $P_b$ includes the sub-elements $P_{1b}$, $P_{2b}$, $P_{3b}$, $P_{4b}$, . . . and are also connected together as a unit by means of connecting rail 55*b* and connecting webs 56*b*. In the non-selected state, there is a cover mask in front of each of the four picture elements $P_a$, $P_b$, $P_c$, $P_d$ in the direction of viewing 72 the picture (FIG. 30), and each of the sub-elements of each picture element is under a common fixed cover mask. Hence, the sub-elements $P_{2a}$, $P_{2b}$, $P_{2c}$, $P_{2d}$ are under the cover mask $M_2$, the sub-elements $P_{3a}$, $P_{3b}$, $P_{3c}$, $P_{3d}$ are under the cover mask $M_3$. The cover mask which would be designated $M_1$ would be shown if the drawing were extended.

The cover masks $M_n$ fastened to the stator in this example are all shaped in a manner similar to a petal and are adjacent. These cover masks $M_n$ are arranged on a circle and they together form a petaled blossom, as shown in FIG. 31. FIG. 29 shows part of this petaled blossom enlarged and in perspective view.

Adjacent cover masks, such as for example, $M_2$ and $M_3$ or $M_3$ and $M_4$ are separated from each other by slots 70 through which the selected sub-elements from the position under a cover mask come to lie in the position above the adjacent cover mask, for example, the selected sub-elements lie under the cover mask $M_2$ and above cover mask $M_3$. In order to make possible this transfer, the picture plane is perpendicular to the direction of viewing and the cover masks ($M_n$) are positioned at an acute angle relative to the picture plane. This oblique position of the cover masks $M_n$ is clearly shown in FIG. 30, but it is less pronounced in reality, since the sub-elements drawn apart in FIGS. 29 and 30 virtually lie on top of each other without a space in between. The slot 70 between the cover masks $M_2$ and $M_3$ is marked in FIG. 30 by a dash-dot line.

By moving one of the four connecting rails $55_a$, $55_b$, $55_c$ or $55_d$ in the direction of arrow 73, all of the sub-elements which are connected by this connecting line are moved from a position underneath the cover masks to a position above the adjacent cover masks, and become visible there from the viewing direction which is in the direction of arrow 72. The sub-elements which are slid over the cover masks constitute at least components of the variable picture.

The selection device with selection slide 11 and guide portion 45 is constructed in a manner similar to the same numbered structure of FIGS. 27 and 28, but only for four picture elements instead of eight are shown and used. Accordingly, the selection slide can only assume four positions and is moved via connecting means 10 by only two final control elements $S_1$ and $S_2$. The engaged members 43*a*, 43*b*, 43*d*, 43*d* are connected by their associated connecting rails 55*a*, 55*b*, 55*c*, 55*d*, as indicated in FIG. 29 by dash-dot lines to the connection points 57*a*, 57*b*, 57*c*, 57*d*. The guide portion 45 is driven by a cam drive (not shown) which functions in a manner similar to the one described in connection with FIG. 27; by means of this cam drive, the selected connecting rail together with its sub-elements can be shifted a distance having the width of one cover mask in the direction of arrow 73 by the width of one cover mask.

In FIGS. 29 and 30, the picture elements $P_b$ together with its sub-elements $P_{1b}$, $P_{2b}$, $P_{3b}$. . . and its connecting rail 55*b* is drawn in a position which indicates a position displaced half-way, as an example.

The total displacement, for example of sub-element $P_{2b}$ extends from a broken line position $P'_{2b}$ which is under the cover mask $M_2$ to a broken-line position $P''_{2b}$ which is above the cover mask $M_3$.

There may be two connecting rails instead of one per picture element with its sub-elements; the connecting rails may also be thin wires.

When arranging the cover masks $M_n$ and the sub-elements $P_n$ underneath in accordance with FIG. 31, the variable picture may be a petaled blossom. With four picture elements as in the example of FIG. 29, petaled blossoms in four different colors may appear as variable pictures. The number of picture elements may also be increased to sixteen, for example.

Figure 33:
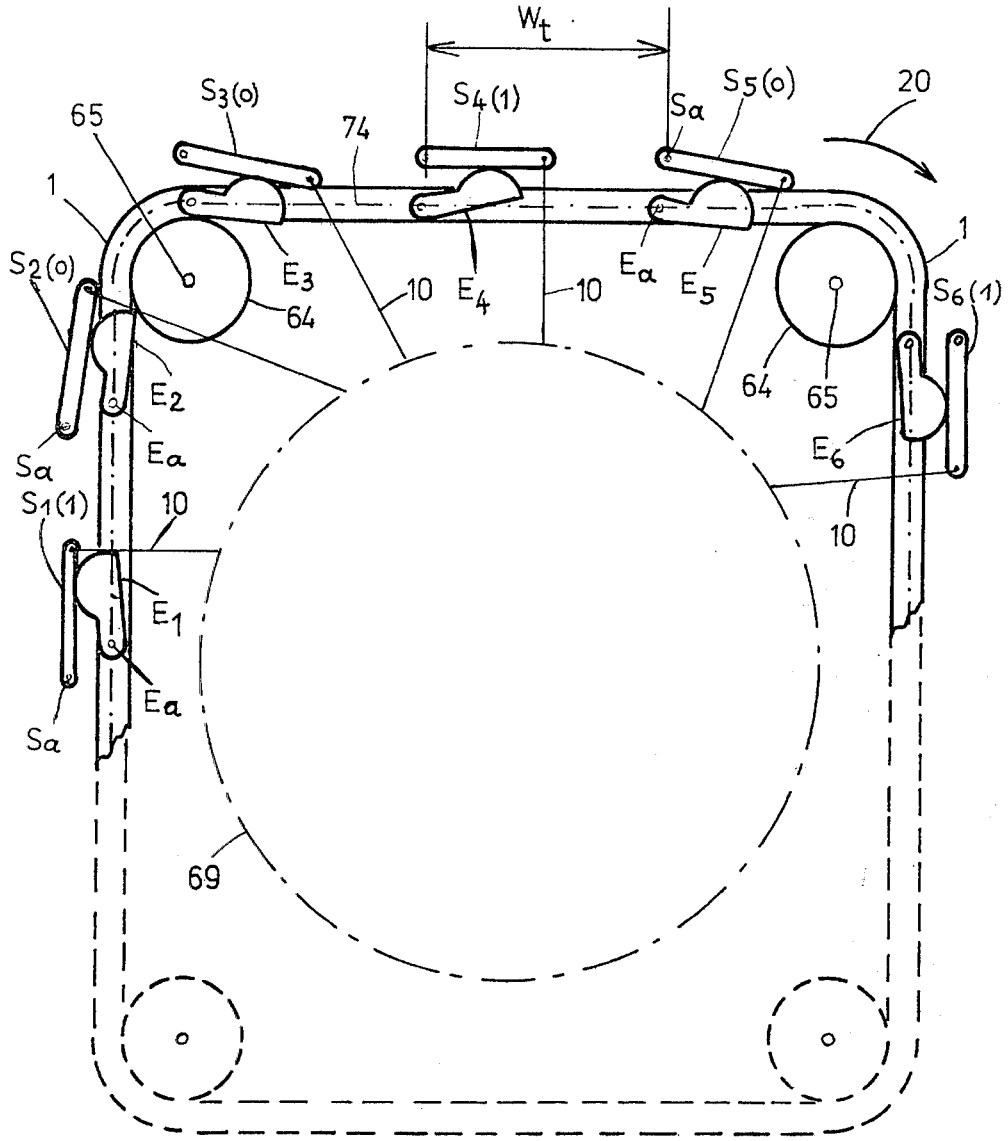
FIG. 33 shows a further embodiment of the invention which is simplified and similar to FIG. 1; and, FIG. 34 shows a detail of an embodiment similar to that of FIG. 4.

Underneath the variable picture with the cover masks $M_n$ of FIG. 31, a second variable picture of similar structure with cover masks $M_n$ and sub-elements $P_n$ underneath may be present. If, for example, sixteen variable picture elements each are present in both variable pictures, which were selected by four separate final control elements each, then the entire variable picture (FIG. 31) can produce $16\times16=256$ different pictures of a flower. In a manner similar to FIG. 3, the program transmitter and the adjustment device can be constructed so as to result in a mechanical feedback register, analogously with the embodiments of FIGS. 3 or 4. The final control element line 66 can also be curved or formed as a circular arch, and the control element carrier 1 can make pivotal movements about the center of this circle. In the embodiments of FIG. 33, the control element carrier 1 is a flexible belt or chain on which the movable control elements are arranged as indicated by the dash-dotted control element line 74. The control element carrier 1 is arranged to be guided on guide rolls 64 which rotate about axes 65. Outside of or displaced from the belt 1, the final control elements $S_N$ are associated with the control elements, and each of the final control elements have fixed final control elements axes $S_a$ at one end and at the other end, each of the final control elements are connected via connecting means 10 to the picture elements which are located in a picture region 69.

Figure 34:
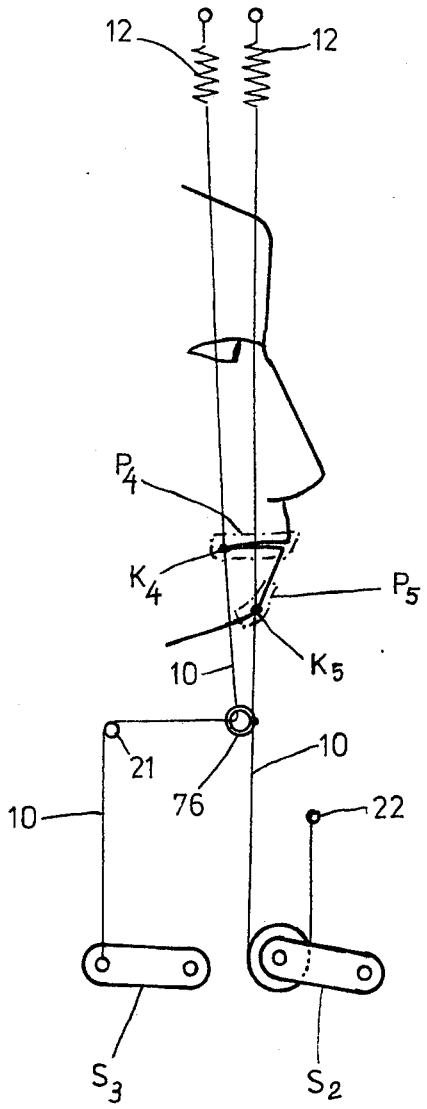

The belt 1 is guided by the guide rolls 64 and is movable in the direction of arrow 20. The function is the same as described in connection with FIG. 1 or 3, and with a movement of belt 1 through a distance $W_t$ in FIG. 34 corresponding to a rotation of rotor 1 through the angular distance $\phi_t$.

Figure 11:
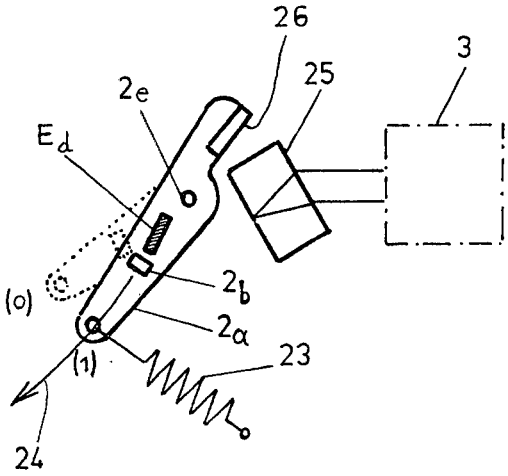
FIGS. 11, 12 and 13 show variations in details of the embodiment of the apparatus in the sections C—C of FIG. 5 as shown in FIGS. 8 to 10.

FIG. 11 shows another embodiment of the program transmitter 3 and of the adjustment device. The operation of the adjustment device is similar to the operation of the adjustment described in connection with FIGS. 8 to 10. The adjustment lever 2a in FIG. 11 has only two positions. One position is drawn as a solid line and has a binary position "1", and the other position is drawn as a dotted line and has a binary position "0". In binary position "1" of the adjustment lever 2a, the single lever Ea of the control elements, as described in FIGS. 4 to 10, is pushed upward to binary position "1" of the control element when moving past adjustment lever 2a on the circular path 24 by its adjustment cam 1b.

In binary position "0" of adjustment lever 2a, there is no action of the adjustment cam 1b on the one-lever $E_d$ moving past on circular path 24, and the control element remains in binary position "0" in which it was placed previously by the zeroing stop 2c (not shown in FIG. 11).

The program transmitter 3 may be an electric pulse generator whose pulses excite the magnet 25. Armature 26 is fastened to the adjustment lever 2a and can move the adjustment lever to the position indicated by the dotted line, when magnet 25 is excited to attract armature 26 and overcomes the face of spring 23.

With the magnet 25 unenergized, the adjustment lever is in binary position "1" as shown in full outline under the action of spring 23, while with the magnet energized the adjustment lever is moved to binary position "0" as shown in dotted outline.

The electronic program transmitter 3 may deliver a random program produced by a noise generator or a pseudorandom program generated by a circuit according to FIG. 1 or any sort of program.

Figure 12:
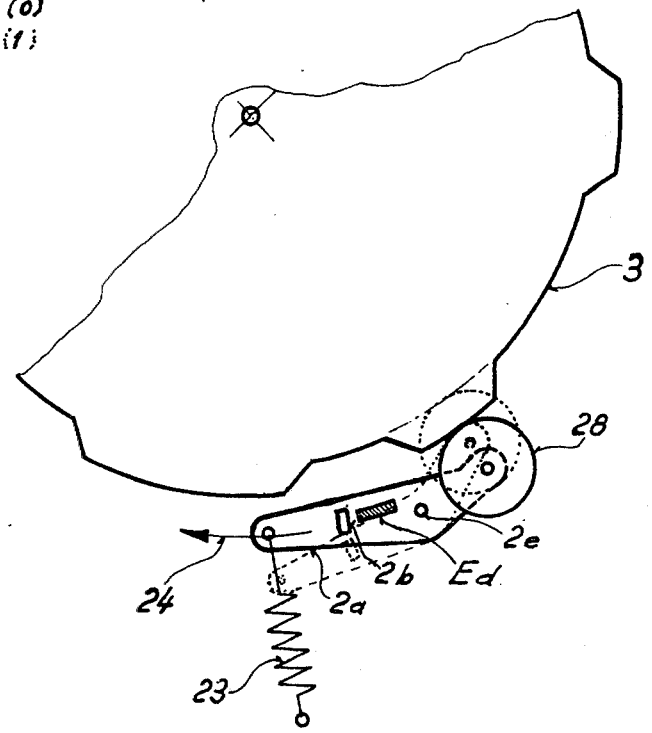

FIG. 12 shows a program transmitter 3 consisting of a cam disk which controls an adjustment lever 2a and acts in a manner similar to that of FIG. 11. Roller 28 is connected with lever 2a and rides on the cam disc.

Figure 13:
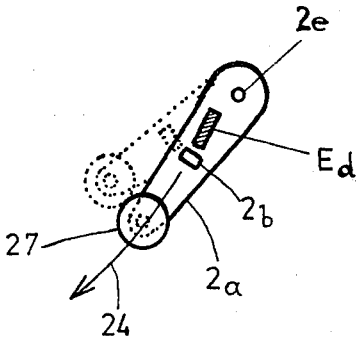

FIG. 13 shows an adjustment lever 2a actuated by means of handle 27 of a type similar to FIGS. 11 and 12, in the situation when the human hand is the program transmitter.

With the selection device described by means of FIG. 27 which is moved by n final control elements and can assume $2^n$ different positions, it is also possible to actuate individual picture elements only rarely. With $n=8$ and $2^n=256$, a certain picture element on the average is actuated only once every 256 shift steps should program transmitter 3 generates a random program.

The variable pictures may also be three-dimensional. For example, the picture of the human face as shown formed on FIG. 4 and FIG. 7, instead of being a profile view, may be a frontal view. And, the facial features may be variable in a direction perpendicular to the picture by means of the connecting means acting on an elastic foil.

While there has been set forth the preferred embodiments of the invention, it will be obvious that various charges and modifications may be made therein without departing from the scope of the invention.

I claim:

1. Apparatus for generating and displaying moving pictures comprising:

a movable control element carrier;

a plurality of control elements arranged on said carrier and constituting mechanical information storages, said information storages comprises a total of at least two mechanical states representing the information stored;

a plurality of outer final control elements, each of said final control elements having two positions and being movable therebetween;

a plurality of variable and position selectable picture elements, each of said picture elements being associated with a respective one of said plurality of final control elements;

mechanical connecting means connecting each said picture element with its said associated final control element;

said positions of said final control elements being variable and responsive to the mechanical states of said control elements, said final control elements being adapted for mechanical association with said control elements for transferring information from said control elements to said final control elements;

said final control elements positively controlling said picture elements by transferring said information to said picture elements through said mechanical connection means; and, means to vary the position of said movable control element carrier, and the mechanical states of said control elements of the varying positions of said movable control element carrier to vary the information transferred to said picture elements and thereby generating variable and different pictures in accordance with the position of said control element carrier and the information contained in the mechanical storage means of said plurality of control elements.

2. Apparatus as claimed in claim 1, including a mechanical adjustment device associated with said control elements;

a program information transmitter to control said adjustment device; and said movable control element carrier is a rotor, for carrying said control elements past said adjustment device, and wherein at least part of said control elements form N register stages ($E_1$ to $E_N$) of a mechanical feedback shift register which includes:

first register stage ($E_1$) (forms) forming a locally fixed shift register input, and a last register stage ($E_N$) forming a locally fixed shift register input, and said last register stage ($E_N$) and a register stage denoted as tapping stage ($E_A$) serving as said program transmitter whose binary positions can be scanned by said associated final control elements ($S_N$, $S_A$) and being applied to said adjustment device;

said adjustment device being arranged as Modulo-2 mixer, for controlling the setting of said first register stage ($E_1$) of the shift register input to the binary positions "zero" or "one" so that rotation of said rotor by one angular distance ($\phi_t$) of said control elements corresponds to one shift step of said shift register.

3. Apparatus as claimed in claim 2, wherein:

said adjustment device includes an adjustment lever and a feedback shift register;

said feedback shift register consisting of N register stages $E_1$ to $E_N$ whose information may consist of binary states "zero" and "one", one of said N register stages being a tapping stage $E_A$ and another of said N register stages being the last register stage $E_N$, two output stages $S_A$ and $S_N$, said output stage $S_A$ being coupled to said tapping stage $E_A$ and said output stage $S_N$ being coupled to said last register stage $E_N$, a rope pulley for guiding a string, the movement of the string being determined by the movement of a final control element associated with said output stage $S_N$ and associated with said last register stage $E_N$ and by the movement of a final control element with said output stage $S_A$ associated with said tapping stage $E_A$, with the sum or difference of these two movements determining the position of said adjustment lever, said adjustment lever being settable to the three positions "middle position", "inner position" and "outer position", with the dependence of these three positions of said adjustment lever on the binary positions of said final control element $S_N$ and of final control element $S_A$ being set forth in the following table:

| Final Control Binary Position Element ($S_N$) | Final Control Binary Position Element ($S_A$) | Adjustment Lever Position |
|---|---|---|
| "0" | "1" | middle |
| "1" | "0" | middle |
| "0" | "0" | outer |
| "1" | "1" | inner |

and where said control elements $E_N$ running past said adjustment lever during rotation of said rotor in the middle position of said adjustment lever are set to the binary position "one" and in the inner and outer positions are left in the binary position "zero".

4. Apparatus according to claim 3, wherein the number N of register $E_N$ and the position of said tapping stage $E_A$ in said shift register are chosen so that the shift register program has a maximum period, and hence any combination of binary positions of all register stages $E_N$ of said shift register is repeated only after $2^N-1$ shift steps.

5. Apparatus according to claim 1, wherein said carrier is a rotor, said rotor being a circular ring body enclosing an area, said control elements being carried by said circular ring body, and said different pictures being arranged within said area enclosing by said circular ring body.

6. Apparatus according to claim 1, wherein said control element carrier is an endless flexible belt and the variable pictures are arranged within the area enclosed by said belt.

7. Apparatus according to claim 1, wherein said control element carrier is a chain and the variable pictures are arranged within the area enclosed by said chain.

8. Apparatus as claimed in claim 1, including:

at least one stationary mechanical adjustment device associated with said control elements to change the information stored in said control elements;

a program information transmitter to control said mechanical adjustment device to determine the information thereof transmitted to said control elements; and means to sequentially transmit the information through the movement of said control element carrier, whereby the information transmitted to said control elements and to said picture elements is variable with the same control elements.

9. Apparatus as claimed in claim 8, wherein said adjustment device includes:

a fixed zeroing stop operatively associated with said control elements, for setting said control elements running past said stop into the binary "zero" position as said movable control element carrier moves past said stop; and, an adjustment lever displaced in the direction of movement of said movable control element carrier relative to said zeroing stop by an angle; and said program information transmitter setting said adjustment lever to at least two positions, one of said positions being effective for changing said control elements to the binary "one" position during movement by said movable control element carrier, and the other of said positions leaving said control elements at binary "zero" position.

10. Apparatus according to claim 8, wherein said control elements each comprise a multi-armed lever which is pivotable about radially directed axes fixed in said movable control element carrier, said axes being located on said carrier in a circle plane and attached at a periphery of said carrier means, into binary positions "zero" and "one", and said control elements include a plurality of action levers in which the binary positions "zero" and "one" are transmittable by actual mechanical contact to said associated final control element a respective one of said action levers associated with said final control element;

said control elements including a further lever arm designated as a zero lever for manually resetting and machine resetting of said control elements to binary position "zero" caused by said zeroing stop;

said adjustment device including an adjustment lever;

said control elements including a third lever arm designated as one lever by which said control elements can be set to the binary position "one" by means of said adjustment lever and the binary positions "zero" and "one" of said control levers are visually readable from the outside; and, said action levers each have wedge-shaped portions making possible the manual resetting of said control elements from one binary position to the other during mechanical contact with said final control elements.

11. Apparatus according to claim 8, including a final control element line;

said final control elements comprise three-arm levers which are pivotable about axes arranged along said final control element line;

one of said control elements being arranged between each two said final control elements, each said last-mentioned control elements having the form of a three-arm lever and having an axis of rotation fixed in said control element carrier and lying on said final control element line; and said control element carrier being movable back and forth in two directions such that during the motion of said control element carrier in one direction the information of the final control elements located on on side of said control elements and/or of said adjustment device is transmittable to said control elements, and during the motion of said control element carrier in the outer direction the information transferred to said control elements is transmittable to said final control elements located on the other side of said control elements.

12. Apparatus as claimed in claim 2, wherein said control elements are mechanically responsive to said program information transmitter and can be set to two different positions denoted as binary position "zero" and binary position "1", the prevailing binary position representing the information of the control element which is variable during the movement of said control element carrier by means of said mechanical adjustment device which is controlled by said program information transmitter.

13. Apparatus as claimed in claim 12, wherein:

said control elements constitute at least parts of a mechanical shift register, each said control element corresponding to a register stage of said shift register, said mechanical program generator contains at least one mechanical Modulo-2 mixer having input information which can be scanned by at least two of said control elements, said mixer having output information representing the program for said shift register for controlling said mechanical adjustment device, said mixer output controlling the binary position of said control element of the shift register input.

14. Apparatus according to claim 13, including m cover masks, and n principal groups $P_{HG\ n}$ each including three foil pairs ($P'_n$,$P''_n$) of opposite-directed foils containing m color wings as picture elements;

whereby in one binary state of said associated final control elements all (3.2.n.m.) said color wings ($P'_F$,$P''_F$) of all said color foils are covered by said m cover masks, and in the other binary state of said associated final control elements the first principal group ($P_{HG\ 1}$) with the color wing colors yellow, cyanic, magenta is displaced by the single-fold amount, the second principal group ($P_{HG\ 2}$) is displaced by the double amount, and the n-th principal group ($P_{HG\ 1}$) is displaced by the n-fold amount of the width ($B_M$) of said cover mask, and wherein m and n are integers.

15. Apparatus according to claim 14, including several groups of concentric displaceable color wing foils coverable by said cover masks are present as picture elements which together jointly produce a flower-like picture.

16. Apparatus as claimed in claim 8 or 13 including:

a rotor forming part of said movable control element carrier and including a ring body arranged on said rotor, and a control element circle on said rotor, a stationary circle concentric with said rotor, said stator having thereon a final control element circle concentric with said control element circle; and said final control elements being arranged one after the other at the same angular distance $\phi_t$ on said final control element circle;

said control elements being arranged on said control element circle with the same angular distance $\phi_t$ between each pair of said adjacent control elements from control element to control element as that of said final control elements where at a certain angle position of said rotor each final control element is associated with one control element and is in mechanical contact, and this association is variable with each rotation of said rotor through an angular distance $\phi_t$; and, said adjustment device being located at least approximately on the periphery of said control element circle.

17. Apparatus as claimed in claim 1 or 13, wherein said carrier is a rotor, and includes a final control element circle arranged outside the periphery of said rotor and concentric therewith, said final control elements comprise levers which are pivotally mounted about axes which are fixed on said final control element circle and run parallel to the axis of said rotor and are arranged on said final control element circle; and the binary positions of said control elements being transmittable by mechanical scanning to said associated final control elements and from them by said connecting means to said picture elements and/or to a selection device of said picture elements.

18. Apparatus as claimed in claim 17, wherein:

said connecting means including pull strings, ropes or pull wires, and tension springs for pressing said final control elements against said action levers of its presently associated control elements thereby making possible mechanical scanning of the information of said control elements by said final control elements; and, said final control elements including switch levers having movable ends, rollers carried at said movable ends having roller axes parallel to the axes of rotation of said final control elements, said rollers scanning the action lever of each said control element; and, a device on the other end of said switch levers for fixing said pull string to several rope pulleys loosely mounted on the roller axis, and the motion amplitude of the roller axis of the final control elements during its shift from one binary position to the other equals a unit path $B_S$.

19. Apparatus according to claim 18, wherein one end of said pull string end is fixed to said roller axis of said switch lever, and said pull string causes said switch lever to move during the shift from one binary state to the other with the single motion amplitude (1 $B_S$) and transmits it to said picture elements.

20. Apparatus according to claim 18, including:

a stator, characterized in that the pull string end is fixed to said stator and a rope pulley on one end of said switch lever, said pull string being guided with 180° contact over said ripe pulley whereby said switch lever motion during the shift from one binary state to the other is transmitted with twice the motion amplitude (2 $B_S$) to said pull string and hence to said picture element.

21. Apparatus according to claim 18, including a stator, said final control elements being fixed to said stator, said pull string end being fixed to said stator; and, deflection rollers and rope pulleys, said pull string being guided singly or multiply around said deflection rollers each with fixed roller axis and said rope pulleys, whereby said switch lever motion can be multiplied and taken off said pull string end and transmitted to said picture element.

22. Apparatus according to claim 18, including:

deflection rollers with fixed roller axes and pulleys;

said pull string end being fixed to a first of said swtich levers and said pull string is alternately guided via said deflection rollers with said fixed roller axis and said rope pulleys of (n−1) additional said switch levers, and that the motion of said first switch lever is transmitted with a $2^0$ fold, hence single motion amplitude (1 $B_s$);

the motion of said second switch lever ($S_{N+1}$) is transmitted with the $2^1$ fold, hence twice the motion amplitude (2 $B_s$), and the motion of the n-th switch lever ($S_{N+n}$) with the $2^{n-1}$ fold motion amplitude ($2^{n-1}B_s$) to said pull string, whereby the second end of the pull string, by adding all individual motions of said switch levers for the n possible combinations of binary positions of n switch levers travels the maximum motion amplitude of ($2^n-1$) $B_s$ and can assume $2^n$ different positions apart by the unit path ($B_s$); and, said second end of said pull string is fastened to said picture element and/or to a selection device of said picture elements.

23. Apparatus according to claim 22, wherein said selection device comprises a selection slide provided with an engaging member; and in each of the $2^n$ positions of said selection slide a different one of the $2^n$ picture elements ($P_n$) is engaged through its engaged member by an engaging member (11*b*), whereby $2^n$ picture elements are selectable with said selection device which can be reset by n final control elements $S_N$.

24. Apparatus according to claim 23, wherein said selectable $2^n$ picture elements are arranged underneath each other in a picture plane and outside the picture region of the variable pictures and the selected picture element including means to machine-shift the selected picture element into the picture region by moving said engaging member.

25. Apparatus according to claim 24, including several groups of $2^n$ picture elements;

each said group being associated with a separate one of said selection devices each resettable by n final control elements;

the picture elements of said groups being arranged outside the picture region, said picture element selected per group being machine shiftable into the picture region by moving said engaging member, and the combination of picture elements being selected from said groups and lying above one another in the picture region represents the variable picture.

26. Apparatus as claimed in claim 18, wherein said picture elements include parts of at least one elastic string which are connected at individual locations controlling said picture elements with said pull strings.

27. Apparatus according to claim 26, wherein said various picture elements contained in said elastic string are variable by means of said pull strings, said elastic string and said pull strings together have the picture characteristics of a human face, with said individual picture elements representing individual facial features.

28. Apparatus as claimed in claim 1 or 13, wherein said elements comprise:

at least partially transparent foils successively located in a direction perpendicular to a foil plane, and/or foils transparent for certain colors, and said individual foils being connected via said connecting means with said associated final control elements and being movable by them in the direction of the foil plane.

29. Apparatus according to claim 28, wherein said foils are made of synthetic material.

30. Apparatus according to claim 28, wherein said foils are made of glass.

31. Apparatus according to claim 28, including at least one foil group comprising three successive foils which are connected by said connecting means with at least one said associated final control element, said foils having at least at individual successive color portions different colors such that a said first foil of said foil group is yellow transparent, the second foil is cyanic transparent and the third foil is magenta transparent, and three of said final control elements having eight possible combinations of binary positions, said three final control elements moving said three foils into position for viewing through the foils to develop the eight combination transparent colors of white, yellow, cyanic, magenta, red, green, blue and black (or six colors, white and black), or a residual color.

32. Apparatus according to claim 31, including a non-transparent cover mask, said color portions of said foils serve as picture elements and are located in a position of said associated final control elements corresponding to one binary position behind said non-transparent fixed cover mask and in the position corresponding to the other binary position said color portions are outside said non-transparent cover mask.

33. Apparatus according to claim 32, wherein the width ($B_F$) of said color portions in the direction of foil movement is at least approximately equal to the width ($B_M$) of said cover mask, and said foil movement caused by said final control elements in n times the width of said cover mask, where $n \geqq 1$ and is an integer.

34. Apparatus according to claim 33, including a plurality of cover masks having gaps therebetween, said foils acting as picture elements are shaped like a fan wheel having a wheel center, said foils having a number of m color portions which have the shape of radially directed color wings of a fan wheel rotating about said wheel center, and each of the m color wings being covered in one of the two binary positions of said associated final control element by one of m fixed cover masks, and in the second binary position said color wings come to lie in said gaps between said cover masks.

35. Apparatus according to claim 34, including a foil pair for each of the three colors;

each said foil pair comprising two fan wheel foils of identical color, whereby said two fan wheel foils of said one foil pair are movable by the same final control element in the opposite direction via said connecting means.

36. Apparatus according to claim 35, including m cover masks, and n principal groups $P_{HG\,n}$ each including three foil pairs ($P'_n$,$P''_n$) of opposite-directed foils containing m color wings as picture elements;

whereby in one binary state of said associated final control elements all (3.2.n.m.) said color wings ($P'_F$,$P''_F$) of all said color foils are covered by said m cover masks, and in the other binary state of said associated final control elements the first principal group ($P_{HG\,1}$) with the color wing colors yellow, cyanic, magenta is displaced by the single-fold amount, the second principal group ($P_{HG\,2}$) is displaced by the double amount, and the n-th principal group ($P_{HG\,1}$) is displaced by the n-fold amount of the width ($B_M$) of said cover mask, and wherein m and n are integers.

37. Apparatus according to claim 36, including several groups of concentric displaceable color wing foils coverable by said cover masks are present as picture elements which together jointly produce a flower-like picture.

38. Apparatus according to claim 1 or 13, including:

a motor, and wherein said carrier is a rotor, and a clock having hands arranged concentric with said rotor, said clock hands and said rotor are driven by said motor.

* * * * *